US010072608B2

(12) United States Patent
Kurita

(10) Patent No.: US 10,072,608 B2
(45) Date of Patent: Sep. 11, 2018

(54) STIRLING ENGINE

(71) Applicants: Hidemi Kurita, Nagano-shi, Nagano (JP); Masanori Shimizu, Hanishina-gun, Nagano (JP)

(72) Inventor: Hidemi Kurita, Nagano (JP)

(73) Assignees: Kurita Hidemi, Nagano-Shi, Nagano (JP); Shimizu Masanori, Hanishina-Gun, Nagano (JP)

( * ) Notice: Subject to any disclaimer, the term of this patent is extended or adjusted under 35 U.S.C. 154(b) by 112 days.

(21) Appl. No.: 15/304,792

(22) PCT Filed: Apr. 13, 2015

(86) PCT No.: PCT/JP2015/061317
§ 371 (c)(1),
(2) Date: Oct. 17, 2016

(87) PCT Pub. No.: WO2015/159837
PCT Pub. Date: Oct. 22, 2015

(65) Prior Publication Data

US 2017/0045018 A1 Feb. 16, 2017

(30) Foreign Application Priority Data

Apr. 18, 2014 (JP) ..... 2014-086054

(51) Int. Cl.
*F02G 1/055* (2006.01)
*F02G 1/043* (2006.01)
*F02G 1/053* (2006.01)

(52) U.S. Cl.
CPC ..... *F02G 1/055* (2013.01); *F02G 1/043* (2013.01); *F02G 1/053* (2013.01); *F02G 2270/30* (2013.01)

(58) Field of Classification Search
CPC ..... F02G 1/043; F02G 1/0435; F02G 1/045; F02G 1/047; F02G 1/05; F02G 1/055;
(Continued)

(56) References Cited

FOREIGN PATENT DOCUMENTS

DE 10034377 C1 * 8/2001 ..... F02G 1/0435
EP 0691467 A1 * 1/1996 ..... F02G 1/043
(Continued)

OTHER PUBLICATIONS

International Search Report, issued in PCT/JP2015/061317 (PCT/ISA/210), dated Aug. 11, 2015.

*Primary Examiner* — Mark Laurenzi
*Assistant Examiner* — Mickey France
(74) *Attorney, Agent, or Firm* — Birch, Stewart, Kolasch & Birch, LLP

(57) ABSTRACT

The displacer 2*d* . . . has a gas retention space Hg . . . formed therein. The gas retention space Hg . . . enables a working gas G to be alternately moved between a heating unit 3*h* side and a cooling unit 3*c* side of a displacer cylinder 2*c* . . . by the movement of the displacer 2*d* . . . . The displacer 2*d* . . . and the displacer cylinder 2*c* . . . have an outer circumferential surface 2*df* and an inner circumferential surface 2*ci*, respectively, formed into such shapes as to be able to permit the movement of the displacer 2*d* . . . and inhibit passage of the working gas G. The displacer 2*d* . . . has a gas passageway 7 which is formed on its outer circumferential surface 2*df* and includes a gas passage groove that allows the gas retention space Hg to communicate with a working gas inlet/outlet 6 . . . provided in the displacer cylinder 2*c* . . . and connected to a power cylinder 5*c*.

18 Claims, 13 Drawing Sheets

(58) Field of Classification Search
CPC .. F02G 1/057; F02G 2270/02; F02G 2244/50; F02G 2253/01; B23P 19/04; Y10T 24/4927
USPC ..... 60/517–520, 522, 526
See application file for complete search history.

(56) References Cited

FOREIGN PATENT DOCUMENTS

| | | | | | |
|---|---|---|---|---|---|
| JP | 59-218345 | A | | 12/1984 | |
| JP | 60101252 | A | * | 6/1985 | ..... F02G 1/0535 |
| JP | 2006-38251 | A | | 2/2006 | |
| JP | 2010-144518 | A | | 7/2010 | |
| JP | 2011-52608 | A | | 3/2011 | |

* cited by examiner

STIRLING ENGINE

TECHNICAL FIELD

The present invention relates to a Stirling engine that is suitably used, for example, in generating electricity with use of various types of heat sources, such as industrial waste heat and solar heat.

BACKGROUND ART

The oscillating flow regenerative heat engine disclosed in PTL 1 and the rotary Stirling engine disclosed in PTL 2 have conventionally been known as examples of Stirling engines including: a displacer body unit having a displacer cylinder in which a working gas and a movable displacer are accommodated; a cooling and heating working unit having a heating unit that heats a first side of the displacer cylinder and a cooling unit that cools a second side of the displacer; a displacer-driving actuator that moves the displacer; and a power output unit having a power cylinder containing a power piston which is moved by the effect of volume change of the working gas in the displacer cylinder, in particular a Stirling engine whose displacer is a rotary displacer having a circular cylindrical shape and a central axis that rotates.

The oscillating flow regenerative heat engine disclosed in PTL 1 is intended to prevent mixture of gases in a plurality of cycles and to uniformize working gas passageways. Specifically, in an oscillating flow regenerative heat engine such as a Stirling refrigeration machine wherein the working gas is sealed inside of a system composed of a compression space of a compressor, a radiator, a regenerator, a heat absorber, and an expansion space of an expander, and the working gas is oscillated when the volume of the compression space and the volume of the expansion space are periodically changed with a predetermined phase difference in order to achieve a cooling capacity at a predetermined temperature from the heat absorber, the compressor is composed of a housing, rotors rotatably mounted in the internal space of the housing, and a plurality of vanes energized in the radially inward direction of the internal space, having tip end parts slidably kept into contact with outer circumferential surfaces of the rotors at all times, and arranged at predetermined intervals in the circumferential direction, and at least one of a plurality of volume-variable working spaces formed by sectioning the internal space by the rotors and the plurality of vanes is applied as the compression space.

Further, the rotary Stirling engine disclosed in PTL 2 is intended to provide a Stirling engine with high thermal efficiency by reducing wasteful heat flows while a working fluid moves in a γ Stirling engine using a rotary displacer. Specifically, along with the rotary displacer, a heat-absorbing regenerator and a heat-releasing regenerator which are fixed to both ends of a sliding heat pipe are internally placed in a displacement chamber. When the rotary displacer is rotated, the working fluid in the displacement chamber moves through the gap between the heat-absorbing regenerator and the heat-releasing regenerator to exchange heat therebetween. The heat transfer between the heat-absorbing regenerator and the heat-releasing regenerator is performed by the sliding heat pipe. The heat energy stored in the heat-absorbing regenerator is returned from the heat-releasing regenerator to the working fluid after a half cycle to increase the heat efficiency. The collision between the rotary displacer and the heat-absorbing regenerator and the heat-releasing regenerator is avoided by the cam mechanism.

CITATION LIST

Patent Literature

PTL 1: Japanese Unexamined Patent Application Publication No. 2006-038251

PTL 2: Japanese Unexamined Patent Application Publication No. 2010-144518

SUMMARY OF INVENTION

Technical Problem

However, the conventional Stirling engines described above, in particular the Stirling engines using a rotary displacer, have the following problems:

First, the working gas in the displacement chamber heated by the heating unit needs to efficiently act on the power cylinder, and heat leaks from a heating unit side to a cooling unit side contributes heavily to a decrease in efficiency. For this reason, a structure has conventionally been employed in which the displacement chamber is sectioned by a movable heat pipe, a plurality of displaceable vanes, or the like. However, measures to prevent heat leaks by these movable mechanisms invite an increase in the number of components and structural complication and, furthermore, in cost and size, and additionally require the attachment of an additional movable mechanism unit, hence also disadvantageous in terms of ensuring durability and reliability.

Second, the structure including a movable heat pipe and a plurality of displaceable vanes or the like requires a movable mechanism unit which moves the heat pipe or the plurality of vanes, thus entailing energy consumption for this purpose and causing a measurable overall decrease in energy conversion efficiency. After all, there has also been further room for improvement in structural aspects, in terms of increasing energy conversion efficiency in the Stirling engine.

It is an object of the present invention to provide a Stirling engine with solutions to such problems occurring in the background art.

Solution to Problem

In order to solve the problems described above, a Stirling engine 1 according to the present invention is disclosed. Sterling engine 1 is a Stirling engine including: a displacer body unit 2 having a displacer cylinder 2*c* (2*ce*, 2*cs*) in which a working gas G and a movable displacer 2*d* (2*de*, 2*ds*) are accommodated; a cooling and heating working unit 3 having a heating unit 3*h* which heats a first side of the displacer cylinder 2*c* (2*ce*, 2*cs*) and a cooling unit 3*c* which cools a second side of the displacer cylinder 2*c* (2*ce*, 2*cs*); a displacer-driving actuator 4 that moves the displacer 2*d*; and a power output unit 5 having a power cylinder 5*c* containing a power piston 5*p* that is moved by the effect of volume change of the working gas G in the displacer cylinder 2 (2*ce*, 2*cs*), wherein the displacer 2*d* (2*de*, 2*ds*) has a gas retention space Hg (Hgs, Hgse) formed therein, the gas retention space Hg (Hgs, Hgse) enabling the working gas G to be alternately moved between a heating unit 3*h* side and a cooling unit 3*c* side of the displacer cylinder 2*c* (2*ce*, 2*cs*) by movement of the displacer 2*d* (2*de*, 2*ds*), the displacer 2*d* (2*de*, 2*ds*) and the displacer cylinder 2*c* (2*ce*, 2*cs*) have an outer circumferential surface 2*df* and an inner circumferential surface 2*ci*, respectively, formed into shapes that can permit the movement of the displacer 2*d* (2*de*, 2*ds*) and inhibit passage of the working gas G, and the displacer 2*d* (2*de*, 2*ds*) has a gas passageway 7 which is formed on its outer circumferential surface 2*df* and includes a gas passage groove that allows the gas retention space Hg (Hgs, Hgse) to communicate with working gas inlet/outlets 6 (6*e*, 6*p*) provided in the displacer cylinder 2*c* (2*ce*, 2*cs*) and connected to the power cylinder 5*c*.

In this case, according to a preferred aspect of the invention, the displacer body unit 2 may include a precisely circular cylindrical rotary displacer 2*d* whose outer circumferential surface 2*df* is parallel to an axial direction Fs with respect to a central axis Fc on which the displacer 2*d* rotates and whose gas retention space Hg is formed by notching a part of the outer circumferential surface 2*df*, and the heating unit 3*h* and the cooling unit 3*c* may be disposed in 180-degree opposed positions, respectively, on an outer surface of the displacer cylinder 2*c* . . . in a radial direction. Further, the gas passageway 7 may be constituted by a front passageway 7*f* (7*fs*) extending from a first end of the gas retention space Hg in a circumferential direction Ff along the circumferential direction Ff of the displacer 2*d* (2*de*, 2*ds*) and a rear passageway 7*r* (7*rs*) extending from a second end of the gas retention space Hg in the circumferential direction Ff along the circumferential direction Ff of the displacer 2*d* (2*de*, 2*ds*). In so doing, the front passageway 7*f* (7*fs*) and the rear passageway 7*r* (7*rs*) may be formed as discontinuous passageways that are independent of each other or as continuous passageways that communicate with each other. It should be noted that the displacer cylinder 2*c* (2*ce*, 2*cs*) may be provided with one or two or more working gas inlet/outlets 6 (6*e*, 6*p*). In addition, the displacer cylinder 2*c* (2*ce*, 2*cs*) may have an auxiliary gas passageway 7*s* (7*sm*, 7*se*) formed on a part of the inner circumferential surface 2*ci* which faces the working gas inlet/outlets 6 (6*e*, 6*p*) and including a gas passage groove communicating with the gas passageway 7 across a predetermined range of angles in the circumferential direction Ff. Furthermore, the displacer body unit 2 may include clearance adjustment mechanisms 8*x*, 8*x* that are capable of adjusting clearances Sx . . . between both end faces of the displacer 2*d* (2*de*) and inner surfaces of ends of the displacer cylinder 2*c* (2*ce*, 2*cs*).

Furthermore, according to a preferred aspect of the invention, the displacer body unit 2 may include a rotary displacer 2*de* whose outer circumferential surface 2*df* is tapered with respect to a central axis Fc on which the displacer 2*de* rotates and whose gas retention space Hg is formed by notching a part of the outer circumferential surface 2*df*. In addition, the heating unit 3*h* and the cooling unit 3*c* may be disposed in 180-degree opposed positions, respectively, on an outer surface of the displacer cylinder 2*ce* in a radial direction, and the displacer body unit 2 may include position adjustment mechanisms 8*y*, 8*y* which are capable of adjusting the position of the displacer 2*de* in an axial direction Fs with respect to the displacer cylinder 2*c*e. Further, the inner circumferential surface of the displacer cylinder 2*c* (2*ce*, 2*cs*) may include an inner circumferential surface(s) 2*dih* and/or 2*dic* corresponding to the heating unit 3*h* and/or the cooling unit 3*c* and formed as a corrugated surface(s) to be larger in actual surface area. In so doing, the corrugated surface(s) may be formed by a plurality of depressed grooves 51*hs* . . . , 51*cs* . . . placed at predetermined intervals Ls . . . in an axial direction Fs and extending along a circumferential direction Ff, and some or all of the depressed grooves 51*hs* . . . , 51*cs* . . . may have their inner surfaces 52 . . . formed as two-dimensional corrugated surfaces. It should be noted that the inner circumferential surface 2*dih* of the displacer cylinder 2*c* (2*ce*, 2*cs*) corresponding to the heating unit 3*h* may be provided with an auxiliary space(s) 9*hi* and/or 9*he* formed by notching a first end side and/or a second end side of the displacer cylinder 2*c* (2*ce*, 2*cs*) in a circumferential direction Ff, and the inner circumferential surface 2*dic* corresponding to the cooling unit 3*c* may be provided with an auxiliary space(s) 9*ci* and/or 9*ce* formed by notching the first end side and/or the second end side of the displacer cylinder 2*c* (2*ce*, 2*c*5) in the circumferential direction Ff. Further, the displacer 2*d* (2*de*) may include a stirring mechanism 10 that stirs the content of the gas retention space Hg. Furthermore, the displacer body unit 2 may include a linear displacer 2*ds* which has a circular cylindrical shape and is displaced forward and backward in an axial direction Fs, and the gas passageway 7 may be provided in the inner circumferential surface of the displacer cylinder 2*cs* and/or the outer circumferential surface of the displacer 2*ds* extending in the axial direction Fs. The gas retention spaces Hgs and Hgse may be provided between end faces of the displacer 2*ds* and inner end faces of the displacer cylinder 2*cs*, and the heating unit 3*h* and the cooling unit 3*c* may be disposed on outer surfaces of end faces of the displacer cylinder 2*cs* in the axial direction Fs, respectively.

Advantageous Effects of Invention

The Stirling engine 1 according to the present invention thus configured brings about the following remarkable effects:

(1) The structure of the displacer body unit 2 only needs two basic components, namely the displacer 2*d* . . . and the displacer cylinder 2*c* . . . and does not need means such as building a sectioned structure with additional components. Therefore, in particular, even a Stirling engine 1 using a rotary displacer 2*d* . . . allows the working gas G heated by the heating unit 3*h* to efficiently act on the power cylinder 5*c* and, what is more, can contribute to a reduction in cost by reducing the number of components and simplifying the structure, and by extension to a reduction in size and weight. Moreover, the absence of a movable mechanism unit added to the displacer 2*d* . . . makes it possible to easily ensure durability and reliability.

(2) The gas retention space Hg, which enables the working gas G to be alternately moved between the heating unit 3*h* side and the cooling unit 3*c* side of the displacer cylinder 2*c* . . . by the movement of the displacer 2*d* . . . , is formed in the displacer 2*d* . . . , and the outer circumferential surface 2*df* of the displacer 2*d* . . . and the inner circumferential surface 2*ci* of the displacer cylinder 2*c* . . . are formed into such shapes as to be able to permit the movement of the displacer 2*d* . . . and inhibit passage of the working gas G. Such an airtight structure makes it possible to effectively inhibit a leak (heat leak) of the working gas G between the heating unit 3*h* and the cooling unit 3*c*, thus making it possible to reduce unnecessary loss of energy and increase energy conversion efficiency in the Stirling engine 1 from the structural aspect of the displacer body unit 2. As a result, the Stirling engine 1 can be used even in a case where the heating unit 3*h* is at a comparatively low temperature, thus making it possible to utilize various heat sources including natural energy such as solar heat and biomass and, furthermore, waste energy such as factory exhaust heat.

(3) According to a preferred aspect, the displacer body unit 2 may include a precisely circular cylindrical rotary displacer 2*d* whose outer circumferential surface 2*df* is parallel to an axial direction Fs with respect to a central axis Fc on which the displacer 2*d* rotates and whose gas retention space Hg is formed by notching a part of the outer circumferential surface 2*df*, and the heating unit 3*h* and the cooling unit 3*c* may be disposed in 180-degree opposed positions, respectively, on an outer surface of the displacer cylinder 2*c* . . . in a radial direction. This allows the displacer body unit 2 to be most rationally and simply structured from a geometric standpoint. Therefore, this embodiment can be carried out as a most suitable embodiment in terms of building the Stirling engine 1 according to the present invention and achieve most suitable performance in terms of effectively ensuring the working effects of the present invention.

(4) According to a preferred aspect, the gas passageway 7 may be constituted by a front passageway 7*f* . . . extending from a first end of the gas retention space Hg . . . in a circumferential direction Ff along the circumferential direction Ff of the displacer 2*d* . . . and a rear passageway 7*r* . . . extending from a second end of the gas retention space Hg . . . in the circumferential direction Ff along the circumferential direction Ff . . . of the displacer 2*d* . . . , and the front passageway 7*f* . . . and the rear passageway 7*r* . . . may be formed as discontinuous passageways that are independent of each other. The front passageway 7*f* . . . and the rear passageway 7*r* . . . , which are independent, bring the flow of the working gas G between the heating unit 3*h* and the cooling unit 3*c* into a blocked state, thus making it possible to surely prevent a heat leak through the gas passageway 7 even in a case where the gas passageway 7 is provided in the outer circumferential surface 2*df* . . . of the displacer 2*d* . . . .

(5) According to a preferred aspect, the gas passageway 7 may be constituted by a front passageway 7*f* . . . extending from a first end of the gas retention space Hg . . . in its circumferential direction Ff along the circumferential direction Ff of the displacer 2*d* . . . and a rear passageway 7*r* . . . extending from a second end of the gas retention space Hg . . . in the circumferential direction Ff along the circumferential direction Ff . . . of the displacer 2*d* . . . , and the front passageway 7*f* . . . and the rear passageway 7*r* . . . may be formed as continuous passageways that communicate with each other. This generates a small amount of heat leak through the gas passageway 7, but eliminates the switching between the front passageway 7*f* . . . and the rear passageway 7*r* . . . to the working gas inlet/outlet 6, thus making it possible to ensure the continuity and stability of the working gas G flowing between the gas passageway 7 and the working gas inlet/outlet 6. This makes it possible to build various embodiments by selecting discontinuous passageways or continuous passageways.

(6) According to a preferred aspect, when the displacer cylinder 2*c* . . . is provided with one working gas inlet/outlet 6, this embodiment can be carried out as the simplest embodiment. When the displacer cylinder 2*c* . . . is provided with two or more working gas inlet/outlets 6, the inlets/outlets of the working gas G can be ensured in a plurality of positions. Therefore, the optimization of input and output positions according to various types of embodiment is enabled for a higher degree of freedom in design, and various embodiments can be build, including the choice in volume of the gas retention space Hg . . . and heat-insulating structure, by changing the aspects of the working gas inlet/outlets 6 . . . .

(7) According to a preferred aspect, the displacer cylinder 2*c* . . . may have an auxiliary gas passageway 7*s* . . . formed on a part of the inner circumferential surface 2*ci* . . . that faces the working gas inlet/outlet 6 . . . and including a gas passage groove communicating with the gas passageway 7 . . . across a predetermined range of angles in the circumferential direction Ff. This makes it possible to ensure various passageways through a combination of the auxiliary gas passageway 7*s* . . . and the gas passageway 7 . . . , thus giving the advantage of increasing the degree of freedom in design, including the choice in volume of the gas retention space Hg . . . and heat-insulating structure.

(8) According to a preferred aspect, the displacer body unit 2 may include clearance adjustment mechanisms 8*x* . . . that are capable of adjusting clearances Sx . . . between both end faces of the displacer 2*d* (2*de*) and inner surfaces of ends of the displacer cylinder 2*c* (2*ce*, 2*cs*). This makes it possible to adjust the clearances Sx . . . between both end faces of the displacer 2*d* (2*de*) and the inner surface of the ends of the displacer cylinder 2*c* (2*ce*, 2*cs*) to the minimum level, thus giving the advantages of enabling easy optimization of the clearances Sx . . . and contribution to further improvement in performance.

(9) According to a preferred aspect, the displacer body unit 2 may include a rotary displacer 2*de* whose outer circumferential surface 2*df* is tapered with respect to a central axis Fc on which the displacer 2*de* rotates and whose gas retention space Hg is formed by notching a part of the outer circumferential surface 2*df*, and the heating unit 3*h* and the cooling unit 3*c* may be disposed in 180-degree opposed positions, respectively, on an outer surface of the displacer cylinder 2*c*e in a radial direction. Simultaneously, the displacer body unit 2 may include position adjustment mechanisms 8*y*, 8*y* that are capable of adjusting a position of the displacer 2*de* in an axial direction Fs with respect to the displacer cylinder 2*ce*. This makes it possible to adjust the position of the displacer 2*de* in the axial direction Fs and adjust the gap (radial gap) between the outer circumferential surface of the displacer 2*de* and the displacer cylinder 2*ce* to the minimum level, thus making it possible to easily optimize the gap and contribute to further improvement in performance.

(10) According to a preferred aspect, the inner circumferential surface of the displacer cylinder 2*c* (2*ce*, 2*cs*) corresponding to the heating unit 3*h* and/or the cooling unit 3*c*, i.e. inner circumferential surface(s) 2*dih* and/or 2*dic*, may be formed as a corrugated surface(s) to enlarge the actual surface area. This makes it possible to increase the actual heat-transfer area between the heating and/or cooling unit(s) 3*h* . . . and/or 3*c* . . . and the working gas G, thus giving the advantage of making it possible to contribute to improvement in heat-exchange efficiency.

(11) According to a preferred aspect, in forming the corrugated surface(s), the corrugated surface(s) may be formed by a plurality of depressed grooves 51*hs* . . . , 51*cs* . . . placed at predetermined intervals Ls . . . in an axial direction Fs and extending along a circumferential direction Ff. This makes it possible to advance the heating starting timing, in addition to increasing the actual surface area with the corrugated surface(s), thus making it possible to further increase heat-exchange efficiency.

(12) According to a preferred aspect, some or all of the depressed grooves 51*hs* . . . , 51*cs* . . . may have their inner surfaces 52 . . . formed as two-dimensional corrugated surfaces. This makes it possible to further increase the actual heat-transfer area between the heating and/or cooling unit(s) 3*h* . . . and/or 3*c* . . . and the working gas G, thus making it possible to contribute to further improvement in heat-exchange efficiency.

(13) According to a preferred aspect, the inner circumferential surface of the displacer cylinder 2*c* (2*ce*, 2*cs*)

corresponding to the heating unit 3*h*, i.e. inner circumferential surface 2*dih*, may be provided with an auxiliary space(s) 9*hi* and/or 9*he* formed by notching a first end side and/or a second end side of the displacer cylinder 2*c* in a circumferential direction Ff, and an inner circumferential surface 2*dic* corresponding to the cooling unit 3*c* may be provided with an auxiliary space(s) 9*ci* and/or 9*ce* formed by notching the first end side and/or the second end side of the displacer cylinder in the circumferential direction Ff. This makes it possible to enforce heating and cooling at the start and/or end of heating and the start and/or end of cooling, thus making it possible to contribute to improvement in heat-exchange efficiency.

(14) According to a preferred aspect, the displacer 2*d* may include a stirring mechanism 10 that stirs the content of the gas retention space Hg. This makes it possible to stir the working gas G in the gas retention space Hg, thus making it possible to contribute to further improvement in heat conversion efficiency.

(15) According to a preferred aspect, the displacer body unit 2 may include a linear displacer 2*ds* that has a circular cylindrical shape and is displaced forward and backward in an axial direction Fs, and the gas passageway 7 may be provided in the inner circumferential surface of the displacer cylinder 2*cs* and/or the outer circumferential surface of the displacer 2*ds* and extends in the axial direction Fs. Simultaneously, the gas retention spaces Hgs and Hgse may be provided between end faces of the displacer 2*ds* and inner end faces of the displacer cylinder 2*cs*, and the heating unit 3*h* and the cooling unit 3*c* may be disposed on outer surfaces of end faces of the displacer cylinder 2*cs* in the axial direction Fs, respectively. Even when the Stirling engine 1 uses the linear displacer 2*ds*, the Stirling engine 1 can bring about certain working effects based on the gas passageway 7 provided according to the present invention.

REFERENCE SIGNS LIST

1: Stirling engine, 2: displacer body unit, 2*d* (2*de*, 2*ds*): displacer, 2*c* (2*ce*, 2*cs*): displacer cylinder, 2*ds*: linear displacer, 2*df*: outer circumferential surface of displacer, 2*ci*: inner circumferential surface of displacer cylinder, 2*ce*: displacer cylinder, 2*dih*: inner circumferential surface corresponding to heating unit, 2*dic*: inner circumferential surface corresponding to cooling unit, 3: cooling and heating working unit, 3*h*: heating unit, 3*c*: cooling unit, 4: displacer-driving actuator, 5: power output unit, 5*p*: power piston, 5*c*: power cylinder, 6 (6*e*, 6*p*): working gas inlet/outlet, 7: gas passageway, 7*f* (7*fs*): front passageway, 7*r* (7*rs*): rear passageway, 7*s* (7*sm*, 7*se*):auxiliary gas passageway, 8*x*: clearance adjustment mechanism, 8*y*: position adjustment mechanism, 9*hi*: auxiliary space, 9*he*: auxiliary space, 9*ci*: auxiliary space, 9*ce*: auxiliary space, 10: stirring mechanism, 51*hs* . . . : depressed groove, 51*cs* . . . : depressed groove, 52 . . . : inner surface of depressed groove, G: working gas, Hg (Hgs, Hgse): gas retention space, Fc: central axis, Fs: axial direction, Ff: circumferential direction, Sx . . . : clearance, Ls . . . : predetermined interval

DESCRIPTION OF EMBODIMENTS

The best embodiment of the present invention is described in detail below with reference to the drawings.

First, a configuration of a Stirling engine 1 according to the present embodiment (basic embodiment) is described with reference to FIGS. 1 to 4.

Figure 1:
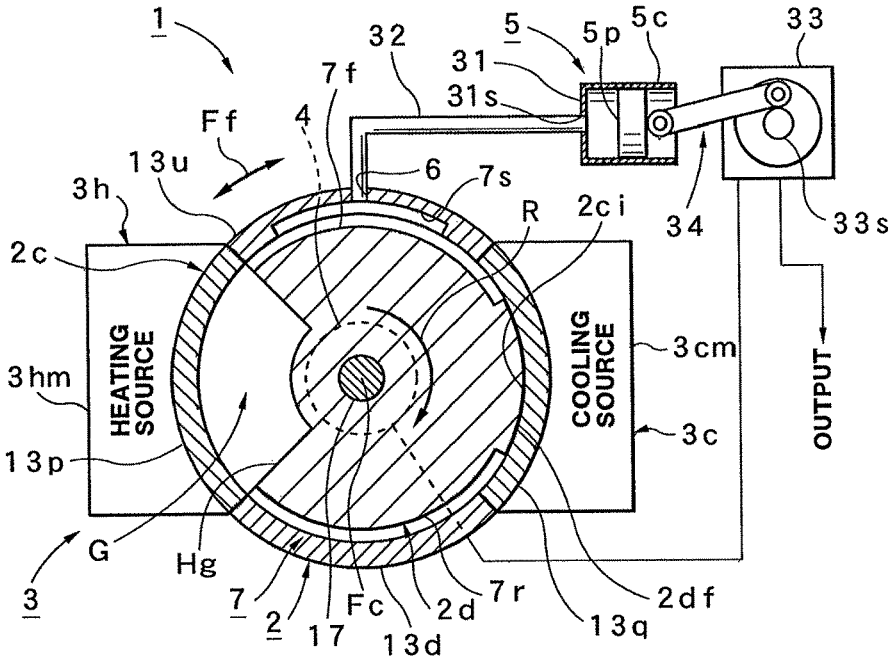
FIG. 1 is a cross-sectional front view theoretically showing an internal structure of a Stirling engine according to a preferred embodiment of the present invention.
Figure 2:
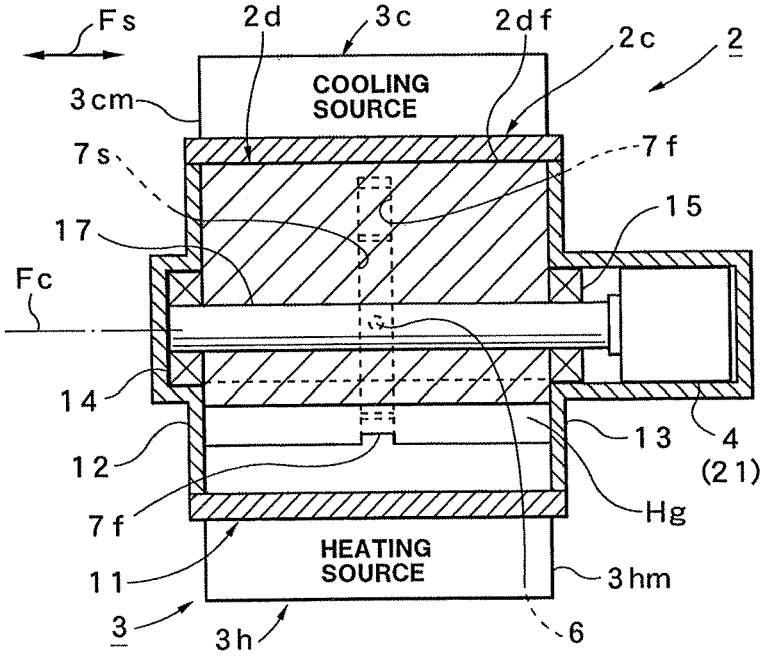
FIG. 2 is a cross-sectional bottom view theoretically showing the internal structure of the Stirling engine.

As shown in FIGS. 1 and 2, a basic configuration of the Stirling engine 1 according to the present embodiment roughly includes a displacer body unit 2, a cooling and heating working unit 3, a displacer-driving actuator 4, and a power output unit 5.

The displacer body unit 2 includes a displacer cylinder 2*c* in which a working gas G is accommodated and a displacer

2*d* is rotatably (movably) accommodated. The working gas G is not limited to any particular gas; however, the working gas G may be gases such as helium gas, nitrogen gas, argon gas, hydrogen gas, or air accommodated for example in a compressed state of approximately 0.2 to 10 MPa. Of course, the working gas G may be accommodated at atmospheric pressures.

The displacer cylinder 2*c* includes a cylindrical cylinder body 11 having openings at both ends thereof, and the openings are closed by circular end-face plates 12 and 13, respectively. In this case, bearing units 14 and 15 comprised of ball bearings or the like are fixed at the respective centers of the end-face plates 12 and 13. The bearing units 14 and 15 rotatably support a displacer shaft 17, which will be described later, and a rotating shaft of an electric motor 21, which will be described later, is coupled to a first end of the displacer shaft 17. For this reason, it is desirable that, as shown in FIG. 2, the end-face plates 12 and 13 cover the displacer shaft 17 and the electric motor 21 as well as the bearing units 14 and 15 so that all of them are located inside and be combined with the cylinder body 11 to bring the inside into a highly airtight hermetically sealed state. This makes it possible to prevent the working gas G from leaking out, thus making it possible to use, as the working gas G, any of the aforementioned low-molecular weight gases such as hydrogen gas or helium gas. Further, the cylinder body 11 is constituted by a combination of four panel members equally divided from one another in a circumferential direction. In this case, as shown in FIG. 1, the four panel members are two heat-insulating panels 13*u* and 13*d* located on the upper and lower sides, respectively, and two heat-transfer panels 13*p* and 13*q* located on the left and right sides, respectively. The heat-insulating panels 13*u* and 13*d* have high heat insulating properties, and the heat-transfer panels 13*p* and 13*q* have high thermal conductivity. Moreover, a working gas inlet/outlet 6 is provided in substantially the middle of the heat-insulating panel 13*u* located on the upper side. The working gas inlet/outlet 6 penetrates from the front side to the back side of the heat-insulating panel 13*u*. In this example, the number of working gas inlet/outlet is 1. Therefore, this embodiment can be carried out as the simplest embodiment.

Figure 3:
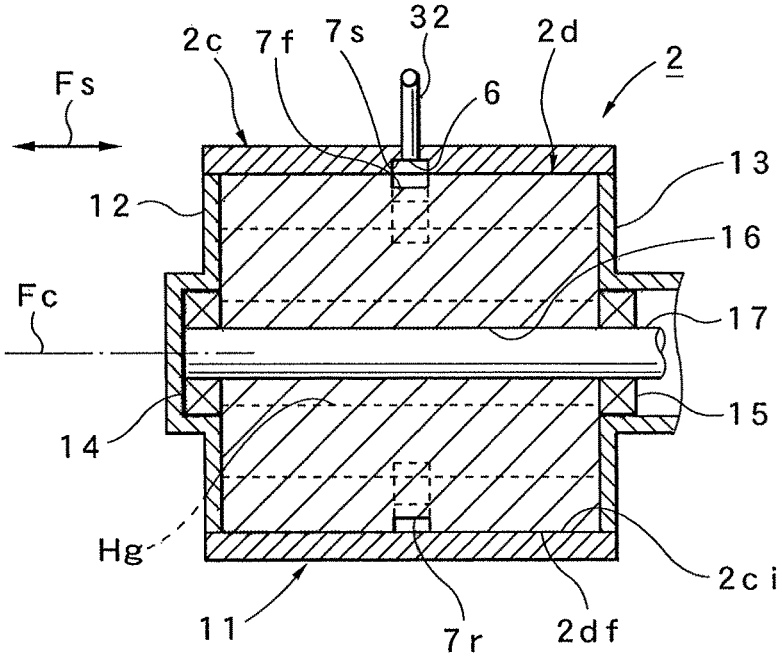
FIG. 3 is a cross-sectional side view theoretically showing the internal structure of the Stirling engine.
Figure 4:
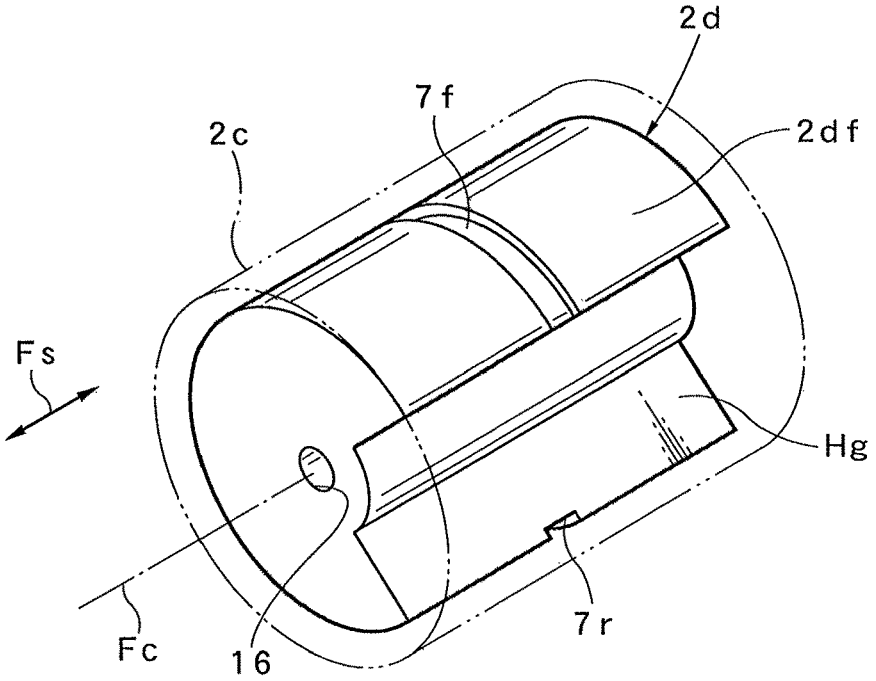
FIG. 4 is a perspective view of a displacer in the Stirling engine.

Meanwhile, as shown in FIG. 4, the displacer 2*d* has a circular cylindrical shape as a whole or, specifically, such a precisely circular cylindrical shape as to have an outer circumferential surface 2*df* that is parallel to an axial direction Fs with respect to a central axis Fc, and as shown in FIG. 3, the displacer 2*d* is fixed by inserting the displacer shaft 17 into a through-hole 16 provided on the central axis Fc. This causes both end sides of the displacer shaft 17 to project outward from both end faces of the displacer 2*d* and be rotatably supported by the bearing units 14 and 15, respectively, so that the displacer 2*d* serves a rotary displacer 2*d* whose central axis Fc rotates. Use of such a rotary displacer 2*d* allows the displacer body unit 2 to be most rationally and simply structured from a geometric standpoint. Therefore, this embodiment can be carried out as a most suitable embodiment in terms of building the Stirling engine 1 according to the present invention and achieve most suitable performance in terms of effectively ensuring the working effects of the present invention. Further, it is desirable that a heat-resistant and heat-insulating lightweight material be selected as a material of which the displacer 2*d* is made.

Moreover, the outer circumferential surface 2*df* of the displacer 2*d* and an inner circumferential surface 2*ci* of the displacer cylinder 2*c* are formed into such shapes as to be able to permit the rotation (movement) of the displacer 2*d* and inhibit passage of the working gas G. This leaves almost no gap between the outer circumferential surface 2*df* of the displacer 2*d* and the inner circumferential surface 2*ci* of the displacer cylinder 2*c*. Furthermore, as shown in FIG. 4, the displacer 2*d* has a gas retention space Hg which is formed on its outer circumferential surface 2*df* and having a shape obtained by cutting out a part of the outer circumferential surface 2*df* of the displacer 2*d*. As shown in FIG. 1, the gas retention space Hg thus exemplified is in the shape of a fan spread at substantially 90 degrees when viewed from the front, and is formed into a shape obtained by wholly cutting out along cutting lines parallel to the axial direction Fs. With this, rotation of the displacer 2*d* enables the working gas G in the gas retention space Hg to alternately move between a heating unit 3*h* side and a cooling unit 3*c* side of the displacer cylinder 2*c*.

Figure 5:
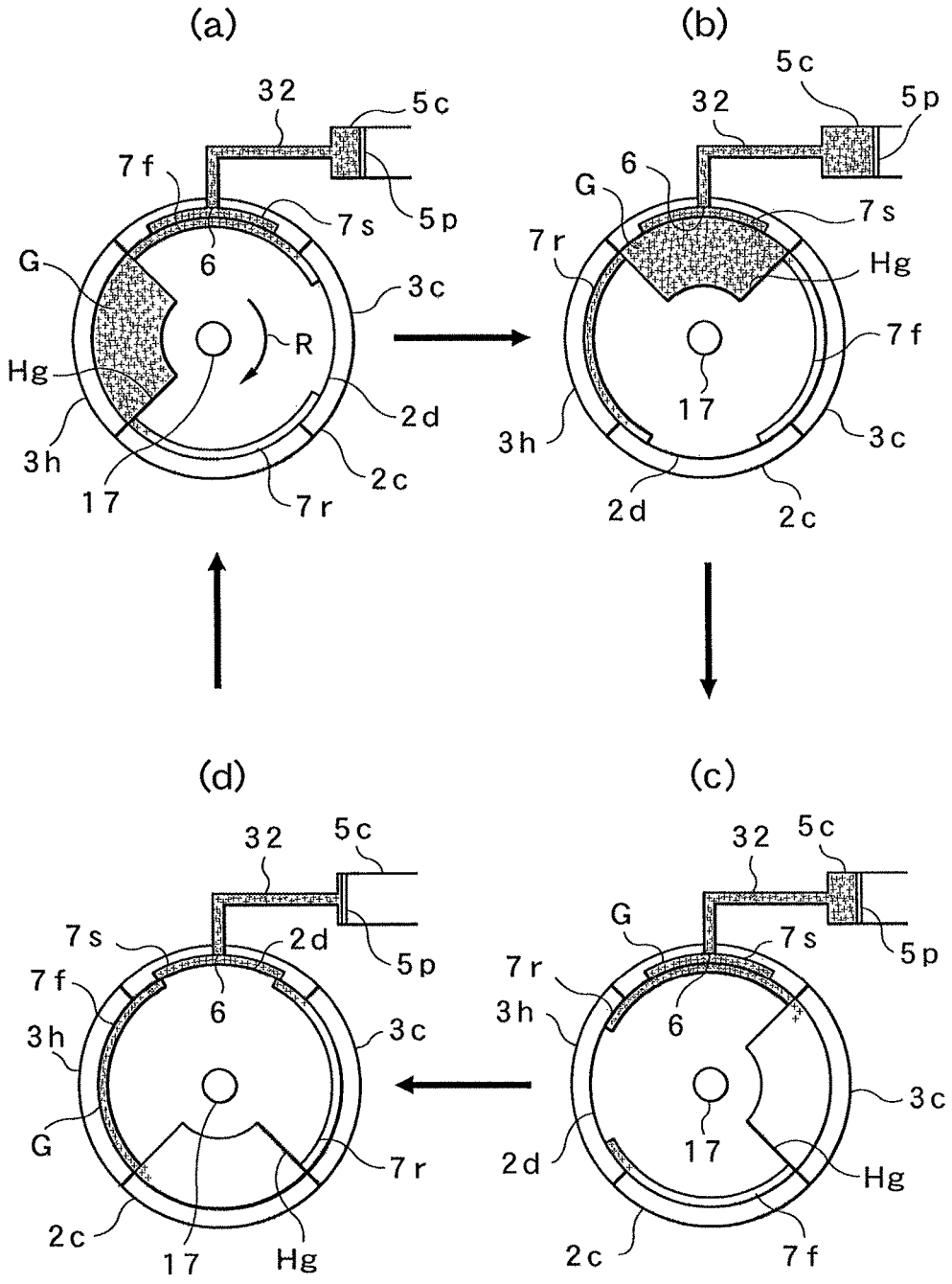
FIG. 5 is an explanatory diagram describing the steps of operation of the Stirling engine.

It should be noted that in a case where, as shown in the present embodiment, the cylinder body 11 is divided into four equal parts in a circumferential direction, the heat-transfer panels 13*p* and 13*q* are disposed respectively on the left and right sites to use for the heating unit 3*h* and the cooling unit 3*c*, the heat-insulating panels 13*u* and 13*d* are disposed respectively on the upper and lower sites, and the circumferential angle of the gas retention space Hg occupying inside the displacer 2*d* is set to be 90 degrees, the working gas G retained in the gas retention space Hg alternately moves between the heating unit 3*h* side and the cooling unit 3*c* side of the displacer cylinder 2*c* as the displacer 2*d* rotates, and does not simultaneously make contact with both regions on the heating unit 3*h* side and the cooling unit 3*c* side (see FIG. 5). This enables minimization of heat leak from the heating unit 3*h* side to the cooling unit 3*c* side through the working gas G, thus making it possible to contribute to an increase in energy conversion efficiency.

Further, the displacer 2*d* has a gas passageway 7 which is formed on its outer circumferential surface 2*df* and includes a gas passage groove that allows the gas retention space Hg to communicate with the working gas inlet and outlet 6 provided in the displacer cylinder 2*c*. The gas passageway 7 is constituted by a front passageway 7*f* and a rear passageway 7*r* formed in the middle of the displacer 2*d* in the axial direction Fs along a circumferential direction Ff. The front passageway 7*f* extends from a first end side of the gas retention space Hg in the circumferential direction Ff, and the rear passageway 7*r* extends from a second end side of the gas retention space Hg in the circumferential direction Ff. Moreover, as shown in FIG. 1, the front passageway 7*f* and the rear passageway 7*r* are formed as discontinuous passageways that are independent of each other. When the front passageway 7*f* and the rear passageway 7*r* are thus formed as discontinuous passageways that are independent of each other, the front passageway 7*f* and the rear passageway 7*r*, which are independent, bring the flow of the working gas G between the heating unit 3*h* and the cooling unit 3*c* into a blocked state, thus making it possible to surely prevent a heat leak through the gas passageway 7 even in a case where the gas passageway 7 is provided in the outer circumferential surface 2*df* of the displacer 2*d*. This enables the gas passageway 7 to communicate with the working gas inlet/outlet 6 provided in the displacer cylinder 2*c*. It should be noted that the working gas inlet/outlet 6 is connected to a power cylinder 5*c*, which will be described later.

Incidentally, in such a configuration, a part of the outer circumferential surface 2*df* of the displacer 2*d* that does not form the gas passageway 7 is present between the front passageway 7*f* and the rear passageway 7*r*, which are independent, to form an angle of rotation by which the inside of the displacer cylinder 2*c* is blocked from the working gas inlet/outlet 6. For this reason, the heat-insulating panel 13*u* (displacer cylinder 2*c*) has an auxiliary gas passageway 7*s* which is formed on a part of the inner circumferential surface 2*ci* that faces the working gas inlet/outlet 6 and includes a gas passage groove across a predetermined range of angles in the circumferential direction Ff. This causes the auxiliary gas passageway 7*s* to bridge between the front passageway 7*f* and the rear passageway 7*r*, allowing the working gas inlet/outlet 6 and the gas retention space Hg to communicate with each other without being blocked, regardless of the angle of rotation of the displacer 2*d* (see FIG. 5(*d*)). Provision of such an auxiliary gas passageway 7*s* makes it possible to ensure various passageways through a combination of the auxiliary gas passageway 7*s* and the gas passageway 7, thus giving the advantage of increasing the degree of freedom in design, including the choice in volume of the gas retention space Hg and heat-insulating structure.

The cooling and heating working unit 3 is constituted by the heating unit 3*h* and the cooling unit 3*c*. The heating unit 3*h* is constituted by attaching a predetermined heating source 3*hm* to the outer surface of the heat-transfer panel 13*p* disposed on a first side of the displacer cylinder 2*c*. The heating source 3*hm* needs only have a function of directly or indirectly heating the heat-transfer panel 13, and utilizable examples of the heating source 3*h* include various types of heating means such as a combustion apparatus using biomass fuel (quantitative biological resources), a heat collector that achieves high temperatures by collecting solar heat, and a heating apparatus that recycles waste energy such as factory exhaust heat (industrial waste heat). Therefore, the specific heating principle of the heating source 3*hm* may be any principle. Further, the cooling unit 3*c* is constituted by attaching a predetermined cooling source 3*cm* to an outer surface of the heat-transfer panel 13*q* disposed on a second side of the displacer cylinder 2*c*. The cooling source 3*cm* needs only have a function of directly or indirectly cooling the heat-transfer panel 13*q*, and utilizable examples of the cooling source 3*cm* include various types of cooling means such as a cooling water supplying apparatus that performs cooling by supplying cooling water to a water jacket attached to the outer surface of the heat-transfer panel 13*q*. Therefore, the specific cooling principle of the cooling source 3*cm* may be any principle. It should be noted that the cooling water is a concept that encompasses various types of liquid such as well water, river water, and tap water. In this case, the cooling water does not mean actively cooled water, but means water that is used to cool the heat-transfer panel 13*q*. For example, the cooling water may be in the form of direct use of waste water from a factory or the like.

On one hand, the displacer-driving actuator 4 has a function of rotating (moving) the displacer 2*d*, and the embodiment exemplifies the electric motor 21. The electric motor 21 also serves as a starter motor. The electric motor 21 has its rotation output shaft coupled to an end of the displacer shaft 17 directly or via a necessary decelerating mechanism or the like.

On the other hand, the power output unit 5 includes the power cylinder 5*c*, which contains a power piston 5*p* which is moved by the effect of volume change of the working gas G in the displacer cylinder 2*c*. In this case, as shown in FIG. 1, the power cylinder 5*c* has a first end closed by an end plate unit 31 and a second end opened. Moreover, a through-hole 31*s* provided in the end plate unit 31 and the working gas inlet/outlet 6 are connected via a connecting tube 32 so that the inside of the displacer cylinder 2*c* communicates with the inside of the power cylinder 5*c* via the gas passageway 7, the working gas inlet/outlet 6, and the connecting tube 32 and the airtightness to the outside is ensured. This makes it possible to convert the change in the volume of the working gas G into a mechanical displacement and take it out as a mechanical output. In the present embodiment, a generator 33 is added so that an electrical output can be taken out from the generator 33. Hence, a rotation input shaft 33*s* of the generator 33 and an outer end face of the power piston 5*p* are connected via a crack mechanism 34. This converts a forward and backward motion of the power piston 5*p* into a rotational motion via the crank mechanism 34, and the rotational motion is imparted to the rotation input shaft 33*s*. Thus, the electrical output from the generator 33 becomes available for taking out as an output of the Stirling engine 1 according to the present embodiment. Further, a part of this electrical output is supplied to the electric motor 21 to be utilized in driving the electric motor 21.

Next, operation of the Stirling engine 1 according to the present embodiment (basic embodiment) is described with reference to FIGS. 5 and 7.

Figure 7:
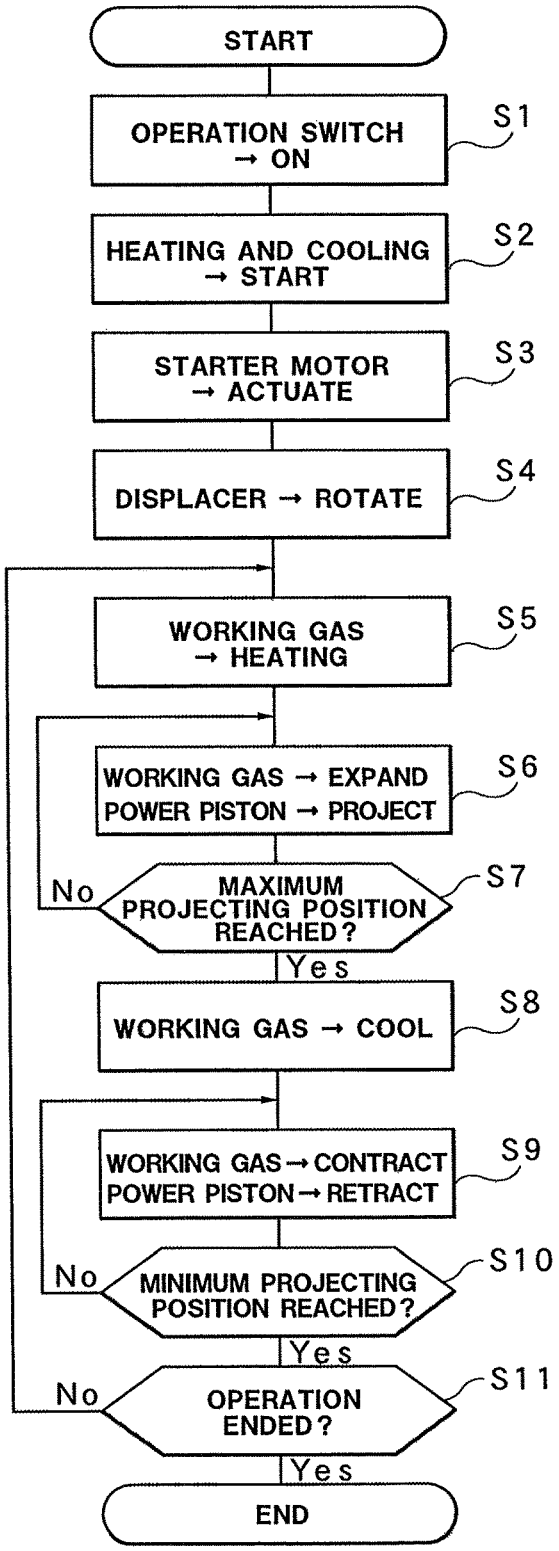
FIG. 7 is a flow chart for explaining the operation of the Stirling engine.

It should be noted that FIG. 5(*a*) to (*d*) show an explanatory diagram of steps of operation of the Stirling engine 1, and FIG. 7 shows a flow chart which explains the operation of the Stirling engine 1. First, an operation switch (not illustrated) is turned on (step S1). This brings the heating unit 3*h* and the cooling unit 3*c* into an operating state so that the heat-transfer panel 13*p* is heated and the other heat-transfer panel 13*q* is cooled (step S2). In so doing, the heating-side heat-transfer panel 13*p* is normally heated by the heating source 3*hm* to several hundred degrees Celsius, and the cooling-side heat-transfer panel 13*q* is cooled by the cooling source 3*cm* (such as cooling water). Once the heating temperature and the cooling temperature reach target temperatures and become stable, a start switch is turned on. This causes the electric motor 21, which also serves as a starter motor, to rotate so that the displacer 2*d* rotates in the direction of the arrow R in FIG. 5(*a*) (steps S3 and S4).

Let it be assumed here that before starting to rotate, the displacer 2*d* is in a position (angle of rotation) shown in FIG. 5(*a*), i.e. a position where the gas retention space Hg of the displacer 2*d* faces leftward and the whole of the gas retention space Hg faces substantially the whole surface of the heating-side heat-transfer panel 13*p*. In this position, the working gas G in the gas retention space Hg is heated by the heating unit 3*h* (step S5). In particular, the working gas G becomes most heated in this position. Therefore, the working gas G expands, and a portion of the working gas G which increased in volume due to this expansion acts on the power cylinder 5*c* via the front passageway 7*f*, the auxiliary gas passageway 7*s*, and the connecting tube 32, so that the power piston 5*p* moves in such a direction as to project (step S6). In the case of the Stirling engine 1 according to the present embodiment, the whole quantity of the working gas G in the gas retention space Hg moves between the heating unit 3*h* side and the cooling unit 3*c* side as the displacer 2*d* rotates, and only the portion of the working gas G which changed by the expansion (and the contraction) of the working gas G moves through the gas passageway 7, the auxiliary gas passageway 7*s*, and the connecting tube 32. For this reason, a loss of pressure (loss of energy) and a loss of heat during passage through the gas passageway 7 and the connecting tube 32 are much smaller than in the case of a linear displacer in which the whole quantity of the working gas in the expansion space and the compression space moves through a gas passageway and the like as the displacer 2*d* reciprocates.

Meanwhile, when the displacer 2*d* rotates in the direction of the arrow R in the drawing and reaches a position shown in FIG. 5(*b*) where the gas retention space Hg faces upward, i.e. when the gas retention space Hg reaches substantially the middle position between the heating unit 3*h* and the cooling unit 3*c*, substantially the maximum volume of the working gas G acts on the power cylinder 5*c*, so that the power piston 5*p* reaches a maximum projecting position (bottom dead center) (step S7). Further, at this point in time (position), where the gas retention space Hg reaches substantially the middle position between the heating unit 3*h* and the cooling unit 3*c*, the whole of the working gas G switches from being heated to being cooled, so that the working gas G starts to be cooled by the cooling unit 3*c* (step S8).

Then, when the displacer 2*d* further rotates, the working gas G contracts due to cooling, and a portion of the working gas G which decreased in volume due to this contraction acts on the power cylinder 5*c* via the rear passageway 7*r*, the auxiliary gas passageway 7*s*, and the connecting tube 32, so that the power piston 5*p* moves in such a direction as to retract (step S9). After this, when the displacer 2*d* reaches a position shown in FIG. 5(*c*) where the gas retention space Hg faces rightward, i.e. a position where the whole of the gas retention space Hg faces substantially the whole surface of the other heat-transfer panel 13*q*, the working gas G in the gas retention space Hg becomes most cooled by the cooling unit 3*c*. This causes the working gas G to further contract, and a portion of the working gas G which decreased in volume due to this contraction acts on the power cylinder 5*c* via the rear passageway 7*r*, the auxiliary gas passageway 7*s*, and the connecting tube 32, so that the power piston 5*p* continues to move in such a direction as to retract. After this, when the displacer 2*d* further rotates and reaches a position shown in FIG. 5(*d*) where the gas retention space Hg faces downward, i.e. when the gas retention space Hg reaches substantially a middle position between the cooling unit 3*c* and the heating unit 3*h*, substantially the minimum volume of the working gas G acts on the power cylinder 5*c*, so that the power piston 5*p* reaches a minimum projecting position (top dead center) (step S10). Further, at this point in time (position), where the gas retention space Hg reaches substantially the middle position between the cooling unit 3*c* and the heating unit 3*h*, the whole of the working gas G switches from being cooled to being heated, so that the working gas G starts to be heated by the heating unit 3*h* (step S11, S5). After this, when the displacer 2*d* further rotates, the working gas G expands due to heating, and a portion of the working gas G which increased in volume due to this expansion acts on the power cylinder 5*c* via the front passageway 7*f*, the auxiliary gas passageway 7*s*, and the connecting tube 32, so that the power piston 5*p* moves in such a direction as to project (step S6). Then, when the displacer 2*d* further rotates, the displacer 2*d* reaches the initial position (angle of rotation) shown in FIG. 5(*a*).

The foregoing is one cycle of the Stirling engine 1 in which the displacer 2*d* makes one rotation, and the same operation is repeatedly and continuously performed unless the operation is stopped, for example, by turning off the operation switch (steps S11, S5 . . . ). Further, the continued rotation of the displacer 2*d* causes the power piston 5*p* to repetitively move between the bottom dead center and the top dead center. As a result, this repetitive movement is transmitted to the generator 33 via the crank mechanism 34, and the generator 33 generates and outputs electricity. That is, a repetitive motion of the power piston 5*p* generated by the rotation of the displacer 2*d* is converted into a rotational motion by the crank mechanism 34 to rotate the rotation input shaft 33*s* of the generator 33. Then, the output from the generator 33 is taken out as an energy output of the Stirling engine 1, and a part of the output is supplied to the electric motor 21 to be used as energy to rotate the displacer 2*d*.

Figure 6:
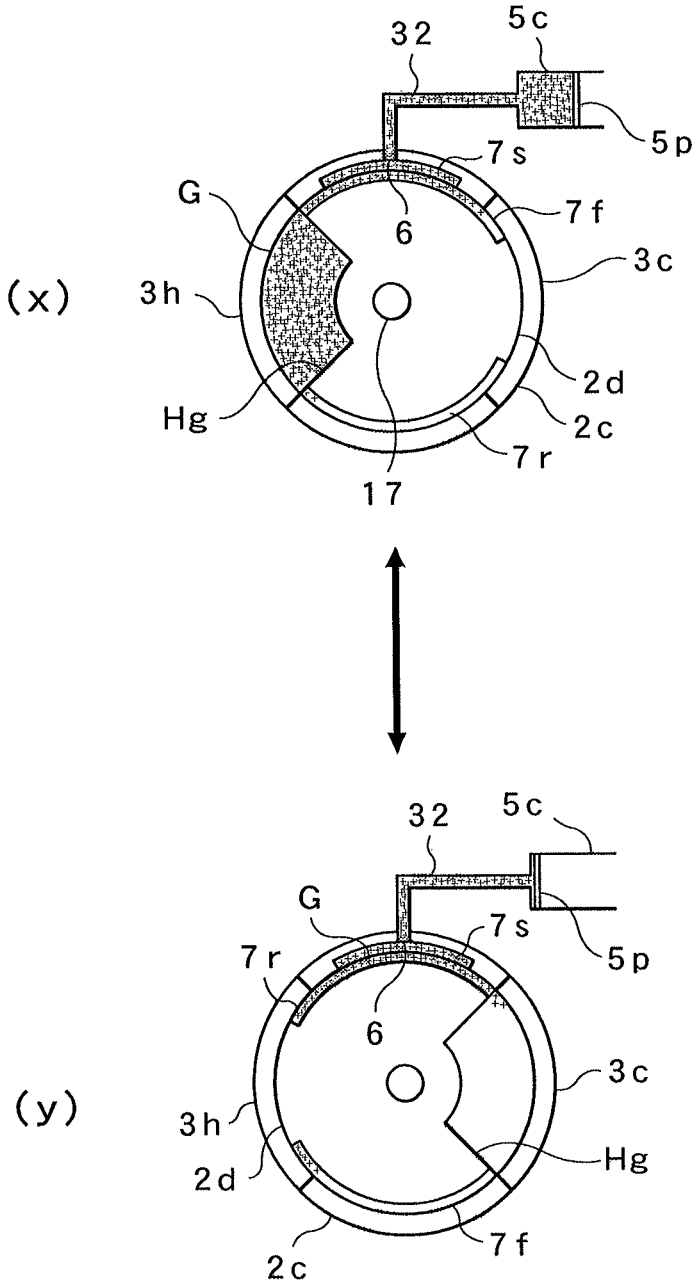
FIG. 6 is an explanatory diagram of steps of operation pertaining to another method of operating the Stirling engine.

Incidentally, while the foregoing operation serves as a method of use for performing a continuous operation (constant-speed control) in which the displacer 2*d* continuously rotates, the Stirling engine 1 according to the present embodiment is also applicable to a method of use for performing an intermittent operation (rectangular wave control) in which the displacer 2*d* intermittently rotates. This method of use for performing an intermittent operation is described with reference to an explanatory diagram of steps of operation shown in FIGS. 6(*x*) and (*y*).

In the intermittent operation, the displacer 2*d* can be intermittently, rotated by 180 degrees at a time by supplying a rectangular wave driving signal to the electric motor 21 that rotates the displacer 2*d*. Let it be assumed here that the displacer 2*d* is in a heating position shown in FIG. 6(*x*). In the heating position, the gas retention space Hg of the displacer 2*d* faces leftward, and the whole of the gas retention space Hg faces the heating unit 3*h*. Moreover, in this heating position, the rotation of the displacer 2*d* is suspended for a predetermined period of time. As this predetermined period of time, a period of time during which the working gas G is heated and the power piston 5*p* reaches a bottom dead center position shown in FIG. 6(*x*) can be selected.

Meanwhile, when the rotation is suspended for the predetermined period of time and the power piston 5*p* reaches the bottom dead center position, the electric motor 21 is actuated. This causes the displacer 2*d* to make a quick rotational movement to a cooling position shown in FIG. 6(*y*). In the cooling position, the gas retention space Hg of the displacer 2*d* faces rightward, and the whole of the gas retention space Hg faces the cooling unit 3*c*. Then, once the displacer 2*d* reaches this cooling position, the rotation is suspended for a predetermined period of time. As this predetermined period of time, a period of time during which the working gas G is cooled and the power piston 5*p* reaches a top dead center position shown in FIG. 6(*y*) can be selected. Further, when the rotation is suspended for the predetermined period of time and the power piston 5*p* reaches the top dead center position, the electric motor 21 is actuated. This causes the displacer 2*d* to make a quick rotational movement to the heating position shown in FIG. 6(*x*). In the intermittent operation, the foregoing operation is repeatedly and continuously performed.

Thus, in the Stirling engine 1 according to the present embodiment, the structure of the displacer body unit 2 only needs two basic components, namely the displacer 2*d* . . . and the displacer cylinder 2*c* . . . and does not need means such as building a sectioned structure with an additional component. Therefore, in particular, even a Stirling engine 1 using a rotary displacer 2*d* . . . allows the working gas G heated by the heating unit 3*h* to efficiently act on the power cylinder 5*c* and, what is more, can contribute to a reduction in cost by reducing the number of components and simplifying the structure, and by extension to a reduction in size and weight. Moreover, the absence of a movable mechanism unit that is added to the displacer 2*d* . . . makes it possible to easily ensure durability and reliability.

Further, the gas retention space Hg, which enables the working gas G to be alternately moved between the heating unit 3*h* side and the cooling unit 3*c* side of the displacer cylinder 2*c* . . . by the movement of the displacer 2*d* . . . , is formed on a part of the outer circumference of the displacer 2*d* . . . , and the outer circumferential surface 2*df* of the displacer 2*d* . . . and the inner circumferential surface 2*ci* of the displacer cylinder 2*c* . . . are formed into such shapes as to be able to permit movement of the displacer 2*d* . . . and inhibit passage of the working gas G. Such an airtight structure makes it possible to effectively inhibit a leak (heat leak) of the working gas G between the heating unit 3*h* and the cooling unit 3*c*, thus making it possible to reduce unnecessary loss of energy and increase energy conversion efficiency in the Stirling engine 1 from the structural aspect of the displacer body unit 2.

In particular, in the case of the Stirling engine 1 according to the present embodiment, the energy needed to rotate (move) the displacer 2*d* is merely equivalent to the sum of the energy lost by friction between the surface of the displacer 2*d* and the working gas G and the energy lost by the frictional resistance of the bearing units 14 and 15 of the displacer shaft 17. Since these losses of energy are very small, the Stirling engine 1 according to the present embodiment can be used even in a case where the heating unit 3*h* is at a comparatively low temperature or a case where the temperature difference between the heating unit 3*h* and the cooling unit 3*c* is comparatively small, thus making it possible to utilize various heat sources including natural energy such as solar heat and biomass and, furthermore, waste energy such as factory exhaust heat.

In addition, as mentioned above, the Stirling engine 1 according to the present embodiment is capable of intermittent operation (rectangular wave control) as well as continuous operation (constant-speed control). In a case where the intermittent operation (rectangular wave control) is performed, the gas retention space Hg formed on a part of the outer circumference of the displacer 2*d* nearly instantaneously moves between the heating unit 3*h* side and the cooling unit 3*c* side of the displacer cylinder 2*c*; therefore, the working gas G in the gas retention space Hg is almost always in either a heated state or a cooled state, and the working gas G takes substantially twice as long to be heated and to be cooled in comparison to the case of continuous operation. For this reason, the heating unit 3*h* and the cooling unit 3*c* transmit substantially twice as large amounts of heating and cooling and engine output to the working gas G as in the case of continuous operation. Moreover, this configuration gives the advantages of making it possible to shorten the length of the vent pipe and simplify the structures of the displacer 2*d* and the displacer cylinder 2*c* (FIGS. 9(*d*), (*e*), FIG. 10(*h*)). On the other hand, this configuration gives negative implications such as a loss of kinetic energy by repetitive rotation and stoppage of the electric motor 21 and the displacer 2*d* and a loss of electric energy and a reduction in durability in the electric motor 21 by repetitive rotation and stoppage. Further, this configuration makes it necessary to attach means for detecting the position of the power piston 5*p* and makes a drive control apparatus more complicated than in the case of continuous operation. Therefore, which operation method to employ can be selected according to the intended use or application.

Next, various types of Stirling engine 1 . . . according to modified embodiments of the present invention are described with reference to FIGS. 8 to 20. It should be noted that FIGS. 8(*a*) to 11 show examples where the displacer body unit 2 are in different geometric forms, that FIGS. 12 to 19 show examples where additional functions are added, and that FIG. 20 shows an example where a linear displacer 2*ds* is used.

Figure 8:
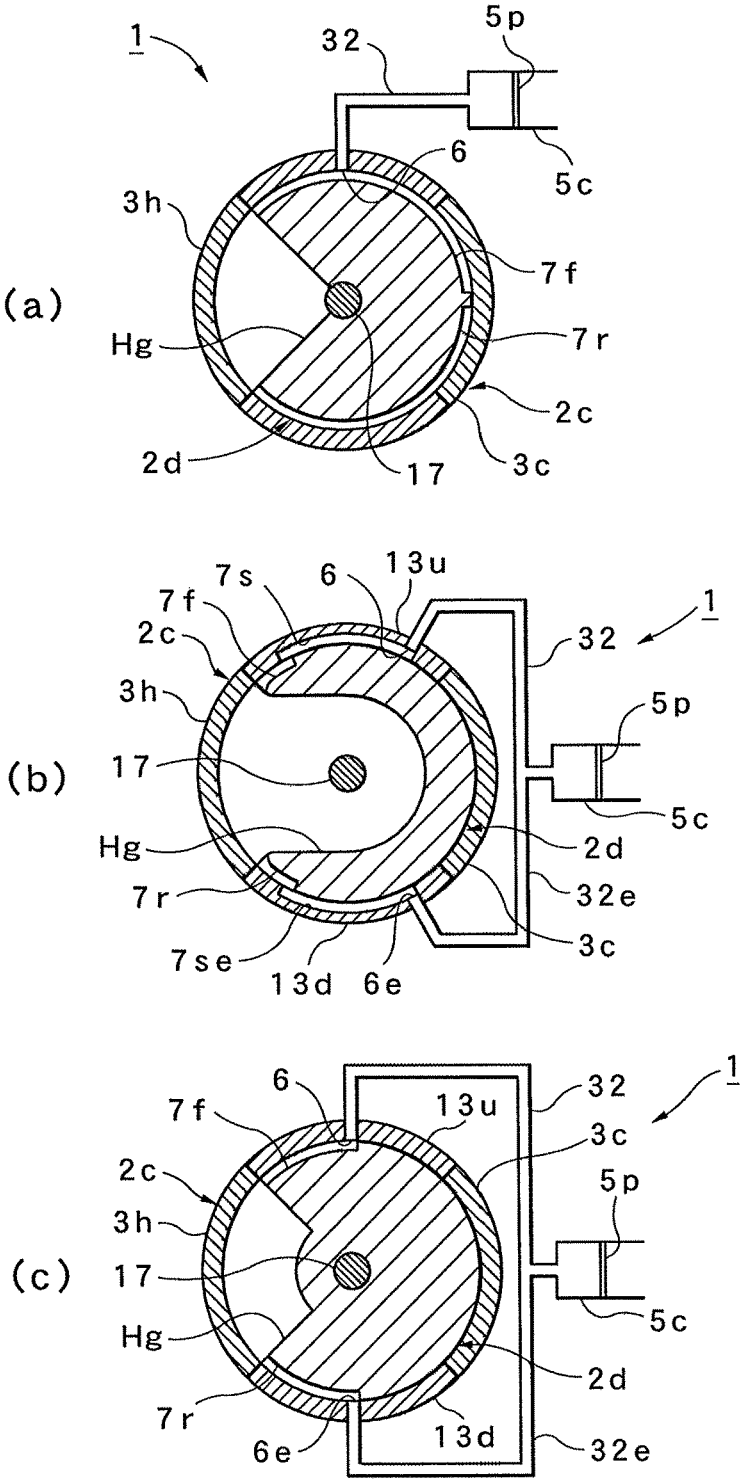
FIG. 8 is a cross-sectional front view theoretically showing an internal structure of a Stirling engine according to a modified embodiment of the present invention.

The modified embodiment shown in FIG. 8(*a*) differs from the embodiment (basic embodiment) shown in FIG. 1 in that no auxiliary gas passageway 7*s* is provided, that the front passageway 7*f* and the rear passageway 7*r* are discontinuously formed but with as small as possible a width of division therebetween or, desirably, with a width equal to (or narrower than) the width of opening of the working gas inlet/outlet 6, and that the radial width of the gas retention space Hg is selected to be approximately equal to the radius. Except for these points, the modified embodiment shown in FIG. 8(*a*) is identical in configuration and operation to the basic embodiment shown in FIG. 1. This modified embodiment shows that the auxiliary gas passageway 7*s* is not always needed, and gives the advantages of simplifying the structure of the displacer cylinder 2*c* and making it possible to make the volume of the gas retention space Hg larger than in the basic embodiment shown in FIG. 1.

The modified embodiment shown in FIG. 8(*b*) differs from the basic embodiment shown in FIG. 1 in that two working gas inlet/outlets 6 and 6*e* are provided, that two auxiliary gas passageways 7*s* and 7*se* communicating with the respective working gas inlet/outlets 6 . . . are provided, and that the volume of the gas retention space Hg is made even larger than in the embodiment of FIG. 8(*a*) by forming the cross-section of the gas retention space Hg into a U shape striding over the displacer shaft 17. Specifically, the first and second working gas inlet/outlets 6 and 6*e* are provided in the upper and lower heat-insulating panels 13*u* and 13*d*, respectively, and the working gas inlet/outlets 6 and 6*e* are convergently connected to the power cylinder 5*c* via connecting tubes 32 and 32*e*, respectively. The provision of the two working gas inlet/outlets 6 and 6*e* allows this modified embodiment to shorten the lengths of the front and rear passageways 7*f* and 7*r* and connect the gas retention space Hg to the power cylinder 5*c* via one or both of the working gas inlet/outlets 6 and 6*e* regardless of the angle of rotation of the displacer 2*d*. In particular, the optimization of input and output positions according to various types of embodiment is enabled for a higher degree of freedom in design, and various embodiments can be build, including the choice in volume of the gas retention space Hg and heat-insulating structure, by changing the aspects of the working gas inlet/outlets 6 . . . . It should be noted that in a case where the volume of the gas retention space Hg is comparatively large as in this modified embodiment, the Stirling engine 1 is suitable for specifications under which the temperature of the heating unit 3*h* is low and the speed of rotation of the displacer 2*d* is low. On the other hand, in a case where the volume of the gas retention space Hg is comparatively small, the Stirling engine 1 is suitable for specifications under which the temperature of the heating unit 3*h* is high and the speed of rotation of the displacer 2*d* is high.

The modified embodiment shown in FIG. 8(*c*) is identical in basic configuration to that shown in FIG. 8(*b*), but differs from that shown in FIG. 8(*b*) in terms of the positions where the two working gas inlet/outlets 6 and 6*e* are provided and, furthermore, the lengths of the front and rear passageways 7*f* and 7*r*. In the embodiment of FIG. 8(*c*), the two working gas inlet/outlets 6 and 6*e* are provided in the middles of the heat-insulating panels 13*u* and 13*d*, respectively, in a circumferential direction. Meanwhile, in the embodiment of FIG. 8(*b*), the two working gas inlet/outlets 6 and 6*e* are provided closer to the cooling unit 3*c*. Thus, the positions where the working gas inlet/outlets 6 and 6*e* are provided can be selected freely. Further, in the embodiment of FIG. 8(*c*), no auxiliary gas passageways 7*s* and 7*se* are needed, as the front passageway 7*f* and the rear passageway 7*r* are set to be sufficiently longer than in the embodiment of FIG. 8(*b*).

Figure 9:
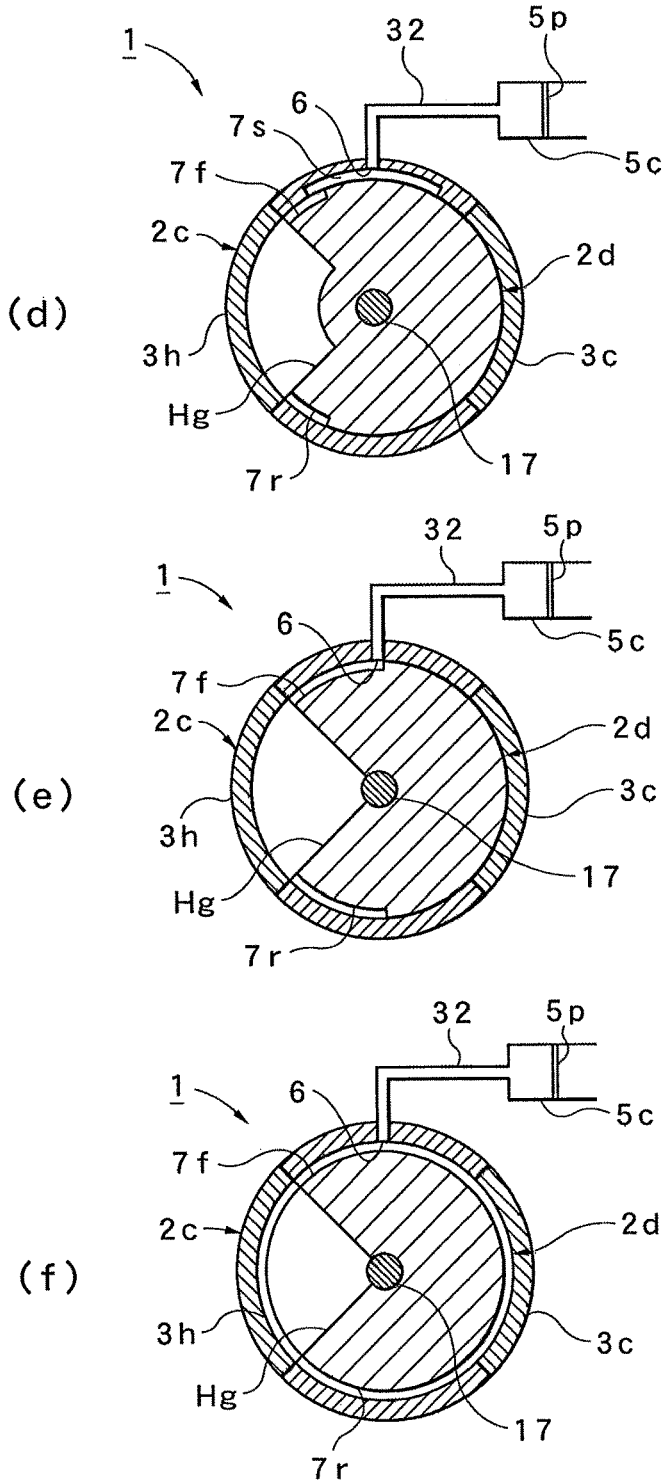
FIG. 9 is a cross-sectional front view theoretically showing an internal structure of a Stirling engine according to another modified embodiment of the present invention.

The modified embodiment shown in FIG. 9(*d*) differs from the basic embodiment shown in FIG. 1 in that the front passageway 7*f* and the rear passageway 7*r* are shorter in length. In this modified embodiment, the front passageway 7*f* and the rear passageway 7*r* are shorter in length, and there is a range of angles of rotation of the displacer 2*d* across which the gas retention space Hg and the working gas inlet/outlet 6 (power cylinder 5*c*) are blocked from each other. In the case thus exemplified, the gas retention space Hg and the working gas inlet/outlet 6 are blocked from each other across a range of angles of rotation of approximately 180 degrees. Therefore, the embodiment of FIG. 9(*d*), in which the front passageway 7*f* and the rear passageway 7*r* are short, can improve the performance of heat insulation between the heating unit 3*h* side and the cooling unit 3*c* side of the outer circumferential surface 2*df* of the displacer 2*d*, but is unsuitable for continuous rotational operation. As such, the embodiment of FIG. 9(*d*) is suitable for the aforementioned method of use in which the displacer 2*d* is intermittently rotated. Meanwhile, the modified embodiment shown in FIG. 9(*e*) is identical in basic configuration to that shown in FIG. 9(*d*), but shows an example where no auxiliary gas passageway 7*s* is provided, where the front passageway 7*f* and the rear passageway 7*r* are long, and where the shape of the gas retention space Hg is the same as that in the embodiment of FIG. 8(*a*). In the embodiment of FIG. 9(*e*), as in that of FIG. 9(*d*), there is a range of angles of rotation of the displacer 2*d* across which the gas retention space Hg and the working gas inlet/outlet 6 are blocked from each other. As such, the embodiment of FIG. 9(*a*) is suitable for the case where intermittent operation is performed.

The modified embodiment shown in FIG. 9(*f*) differs from the modified embodiments shown in FIGS. 8 and 9(*e*) in that the front passageway 7*f* and the rear passageway 7*r* are continuously formed. That is, in forming the gas passageway 7, the front passageway 7*f*, which extends from the first end side of the gas retention space Hg in the circumferential direction Ff along the circumferential direction Ff of the displacer 2*d*, and the rear passageway 7*f*, which extends from the second end side of the gas retention space Hg in the circumferential direction Ff along the circumferential direction Ff of the displacer 2*d*, are provided, and the front passageway 7*f* and the rear passageway 7*r* are formed as continuous passageways that communicate with each other. Forming the front and rear passageways 7*f* and 7*r* as such continuous passageways generates a small amount of heat leak through the gas passageway 7, but eliminates the switching between the front passageway 7*f* and the rear passageway 7*r* to the working gas inlet/outlet 6, thus making it possible to ensure the continuity and stability of the working gas G flowing between the gas passageway 7 and the working gas inlet/outlet 6. This makes it possible to build various embodiments by selecting discontinuous passageways or continuous passageways according to the status of the heat source, the intended use, and the like.

Figure 10:
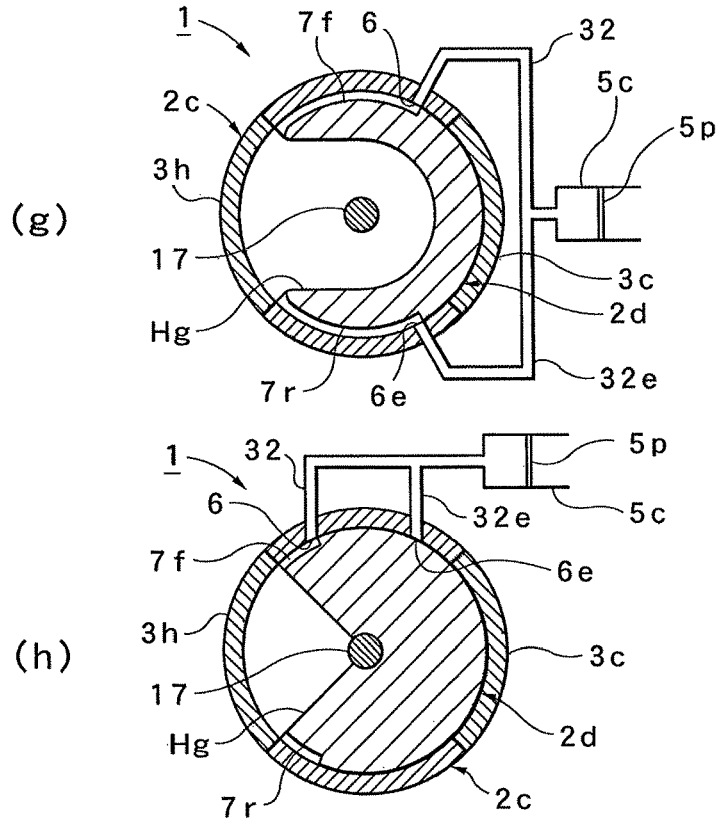
FIG. 10 is a cross-sectional front view theoretically showing an internal structure of a Stirling engine according to another modified embodiment of the present invention.

The modified embodiment shown in FIG. 10(*g*) is identical in basic configuration to that shown in FIG. 8(*b*), but differs from it in that auxiliary gas passageways 7*s* and 7*se* are not provided. However, except for this point, the modified embodiment shown in FIG. 10(*g*) is identical in basic configuration to that shown in FIG. 8(*b*) and can therefore perform the same operation. Meanwhile, the modified embodiment shown in FIG. 10(*h*) is identical in basic configuration to that shown in FIG. 9(*e*), but differs from it in that two working gas inlet/outlets 6 and 6*e* are provided at a distance from each other on the upper heat-insulating panel 13*u* and that the front passageway 7*f* and the rear passageway 7*r* are shorter in length. In this modified embodiment, there is a range of angles of rotation of the displacer 2*d* across which the gas retention space Hg and the working gas inlet/outlet 6 (power cylinder 5*c*) are blocked from each other. Therefore, this modified embodiment can improve the performance of heat insulation between the heating unit 3*h* side and the cooling unit 3*c* side of the outer circumferential surface 2*df* of the displacer 2*d*, but is unsuitable for continuous rotational operation. As such, this modified embodiment is suitable for the aforementioned method of use in which the displacer 2*d* is intermittently rotated.

Figure 11:
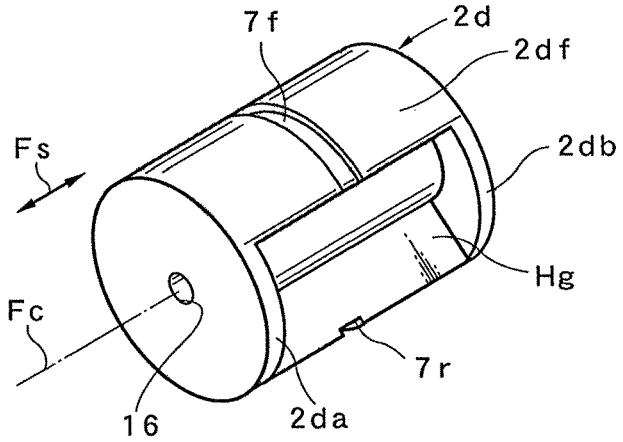
FIG. 11 is a perspective view of a displacer in a Stirling engine according to another modified embodiment of the present invention.

On the other hand, the modified embodiment shown in FIG. 11 is one obtained by changing the method of forming the gas retention space Hg in the displacer 2*d*. In the basic embodiment shown in FIG. 1, as shown in FIG. 4, the gas retention space Hg is formed by completely notching a part of the displacer 2*d* between first and second end faces of the displacer 2*d*. Meanwhile, certain parts of the displacer 2*d* according to the embodiment of FIG. 11, which are on both the first and second end-face sides of the displacer 2*d*, are not notched but left as barrier parts 2*da* and 2*db* of predetermined width in the axial direction Fs. That is, while the gas retention space Hg of the embodiment shown in FIG. 1 is a space opened in the axial direction, the gas retention space Hg of the embodiment shown in FIG. 11 is a space closed in the axial direction. This makes the volume of the gas retention space Hg smaller in the embodiment shown in FIG. 11, but is advantageous in that the barrier parts 2*da* and 2*db* inhibit the working gas G retained in the gas retention space Hg from leaking toward the end faces.

Figure 12:
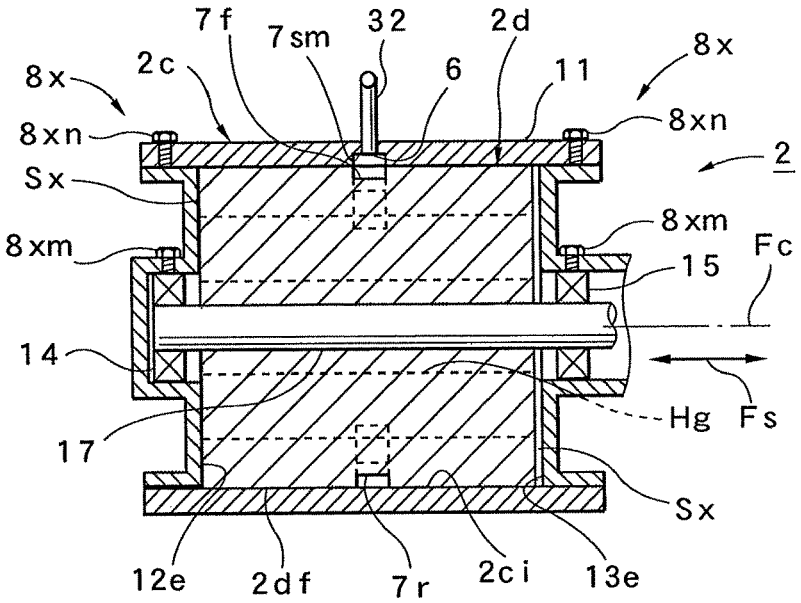
FIG. 12 is a cross-sectional side view theoretically showing an internal structure of a Stirling engine according to another modified embodiment of the present invention.

The modified embodiment shown in FIG. 12 is one in which, in configuring the displacer cylinder 2*c*, adjustment end-face plates 12*e* and 13*e* are configured by changing the shapes of the pair of end-face plates 12 and 13, which close the openings at both ends of the cylinder body 11. In particular, the modified embodiment shown in FIG. 12 is one in which the adjustment end-face plates 12*e* and 13*e* are configured to be relatively displaceable in the axial direction Fs with respect to the cylinder body 11 and the bearing units 14 and 15, respectively, which support the displacer shaft 17, in which the adjustment end-face plates 12*e* and 13*e* are fixable to the cylinder body 11 by fixing screws 8*xn*, 8*xn* . . . , and in which the adjustment end-face plates 12*e* and 13*e* are fixable to the bearing units 14 and 15 by fixing screws 8*xm*, 8*xm* . . . .

This makes it possible to configure clearance adjustment mechanisms 8*x*, 8*x* that are capable of adjusting clearances Sx . . . between both end faces of the displacer 2*d* and the inner surfaces of the ends of the displacer cylinder 2*c*. In this case, in making a clearance adjustment on an adjustment end-face plate 12*e* side, the clearance Sx between the first end face of the displacer 2*d* and the inner surface of the adjustment end-face plate 12*e* can be adjusted by loosening the fixing screws 8*xn* . . . and 8*xm* . . . and displacing the adjustment end-face plate 12*e* in the axial direction Fs. Further, after the adjustment, the fixing screws 8*xn* . . . and 8*xm* . . . need only be tightened for fixation. Furthermore, a clearance adjustment on an adjustment end-face plate 13*e* side can be made in the same manner as an adjustment end-face plate 12*e* side. It should be noted that, in FIG. 12, the adjustment end-face plate 12*e* is in a state where the clearance Sx has been adjusted to be substantially 0, and the adjustment end-face plate 13*e* is in a state where the clearance Sx is comparatively large, i.e. a pre-adjustment state.

Provision of such clearance adjustment mechanisms 8*x* . . . makes it possible to adjust the clearances Sx . . . between both end faces of the displacer 2*d* and the inner surface of the ends of the displacer cylinder 2*c* (inner surfaces of the adjustment end-face plates 12*e* and 13*e*) to the minimum levels, thus giving the advantages of making it possible to easily optimize the clearances Sx . . . and contribute to further improvement in performance.

Figure 13:
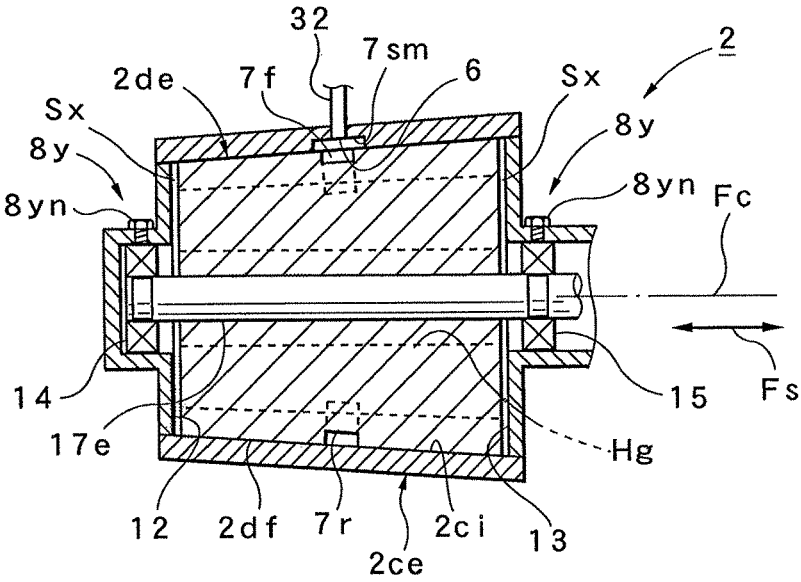
FIG. 13 is a cross-sectional side view theoretically showing an internal structure of a Stirling engine according to another modified embodiment of the present invention.

The modified embodiment shown in FIG. 13 is one in which the displacer body unit 2 includes a rotary displacer 2*de* whose central axis Fc rotates and whose outer circumferential surface 2*df* is tapered, and in which the displacer body unit 2 includes position adjustment mechanisms 8*y*, 8*y* that are capable of adjusting the position of the rotary displacer 2*de* in the axial direction Fs with respect to a displacer cylinder 2*ce*. In this case, for example, as shown in FIG. 13, the position adjustment mechanisms 8*y* . . . can be configured by providing bearing units 14 and 15, which support a displacer shaft 17*e*, so that the bearing units 14 and 15 can be displaced in the axial direction Fs, and fixing the bearing units 14 and 15 with fixing bolts 8*yn*, 8*yn* . . . that can be loosened. Provision of such position adjustment mechanisms 8*y* . . . makes it possible to adjust the position of the displacer 2*de* in the axial direction Fs and adjust the gap (radial gap) between the outer circumferential surface of the displacer 2*de* and the displacer cylinder 2*ce* to the minimum level, thus making it possible to easily optimize the gap and contribute to further improvement in performance. It should be noted that since the displacer 2*de* is displaceable in the axial direction Fs, the auxiliary gas passage 7*s* (or the working gas inlet/outlet 6) is formed as an auxiliary gas passageway 7*sm* that becomes wider in the axial direction Fs. This allows the gas passageway 7 to surely communicate with the working gas inlet/outlet 6 regardless of the position of the displacer 2*de* in the axial direction Fs.

Figure 14:
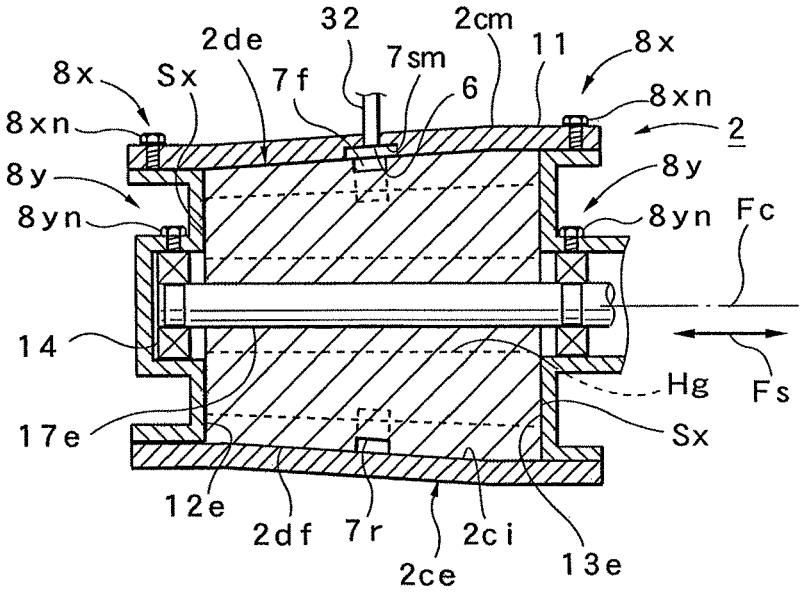
FIG. 14 is a cross-sectional side view theoretically showing an internal structure of a Stirling engine according to another modified embodiment of the present invention.

The modified embodiment shown in FIG. 14 is one obtained by adding the modified embodiment of FIG. 12 to the modified embodiment of FIG. 13. That is, since the modified embodiment of FIG. 13 is configured not to include the modified embodiment of FIG. 12, the clearances Sx . . . on the sides of the bearing units 14 and 15 are both comparatively large. On the other hand, in the modified embodiment of FIG. 14, parts that are parallel to the axial direction Fs, i.e. parts that are uniform in diameter over a predetermined width in the axial direction Fs, are provided on certain parts of both end sides of the cylinder body 11 in the axial direction Fs. These parts are identical in configuration to those of the modified embodiment of FIG. 12. Therefore, the fixing bolts 8*yn* . . . of the position adjustment mechanisms 8*y* . . . of FIG. 14 also serve as the fixing bolts 8*xm* . . . of the clearance adjustment mechanisms 8*x* . . . , so the embodiment includes both the clearance adjustment mechanisms 8*x* . . . and the position adjustment mechanisms 8*y* . . . .

In this case, a part that is parallel to the axial direction Fs, i.e. a part that is uniform in diameter over a predetermined width in the axial direction Fs, is provided on a part of the end on the side of the displacer 2*d* that is larger in diameter. Such a configuration makes it possible, without requiring precision work or fine adjustment, to prevent contact between the outer circumference surface 2*df* and the inner circumferential surface 2*ci* of the displacer cylinder 2*ce* at the end on the side of the displacer 2*d* that is larger in diameter, although the displacer body unit 2 becomes slightly complex in structure. Such a part of the end on the side of the displacer 2*d* which is larger in diameter does not necessarily need to be provided as a part that is uniform in diameter, and even an embodiment without such a part can be carried out.

It should be noted that FIG. 14 shows a state where the position of the displacer 2*de* in the axial direction Fs has been adjusted by the position adjustment mechanisms 8*y* . . . and the gap (radial gap) between the outer circumferential surface of the displacer 2*de* and the displacer cylinder 2*ce* has been adjusted to substantially 0 (minimum level), and shows a state where the clearances between both end faces of the displacer 2*de* and the inner surface of the ends of the displacer cylinder 2*ce* (inner surfaces of the adjustment end-face plates 12*e* and 13*e*) have been adjusted by the clearance adjustment mechanisms 8*x* . . . and the clearances Sx . . . between both end faces of the displacer 2*de* and the inner surfaces of the adjustment end-face plates 12*e* and 13*e* have been adjusted to substantially 0 (minimum levels).

Figure 15:
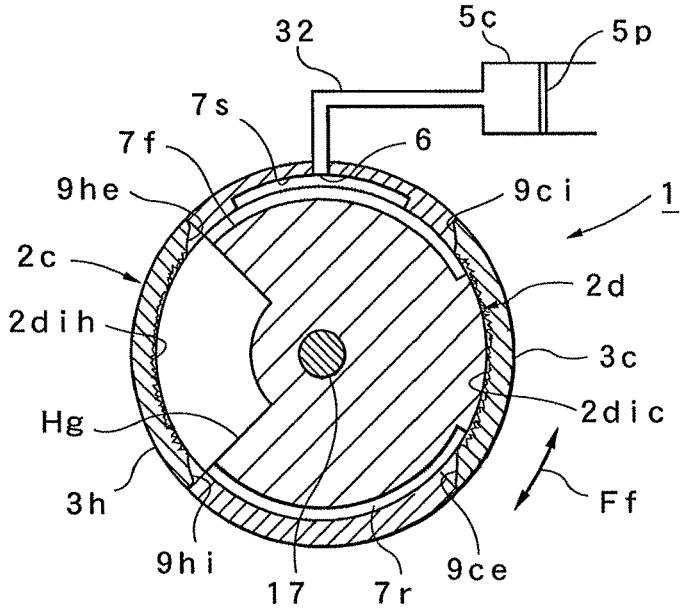
FIG. 15 is a cross-sectional front view theoretically showing an internal structure of a Stirling engine according to another modified embodiment of the present invention.

The modified embodiment shown in FIG. 15 differs from the basic embodiment shown in FIG. 1 in that inner circumferential surfaces 2*dih* and 2*dic* of the displacer cylinder 2*c* which correspond to the heating unit 3*h* and the cooling unit 3*c* are formed by corrugated surfaces to enlarge the actual surface area, that a first and/or second end side(s) of the inner circumferential surface 2*dih*, which corresponds to the heating unit 3*h* of the displacer cylinder 2*c*, in the circumferential direction is/are notched to provide a small-capacity auxiliary space(s) 9*hi* and/or 9*he* in which the working gas G is always preliminarily heated, and that a first and/or second end side(s) of the inner circumferential surface 2*dic*, which corresponds to the cooling unit 3*c* of the displacer cylinder 2*c*, in the circumferential direction is/are notched to provide a small-capacity auxiliary space(s) 9*ci* and/or 9*ce* in which the working gas G is always preliminarily cooled. In this case, each of the auxiliary spaces 9*hi*, 9*he*, 9*ci*, and 9*ce* can be formed into oblique sliced shapes so that the notches become gradually deeper from the inner sides towards the outer edge sides in the circumferential direction Ff of the inner circumferential surfaces 2*dih* and 2*dic*. The provision of the inner circumferential surfaces 2*dih* and 2*dic* formed by corrugated surfaces to enlarge surface area makes it possible to increase the actual heat-transfer area between the heating and cooling units 3*h* and 3*c* and the working gas G, thus giving the advantage of enabling contribution to improvement in heat-exchange efficiency. Further, provision of the auxiliary spaces 9*hi*, 9*he*, 9*ci*, and 9*ce* enables enhancement of heating and cooling at the start and/or end of heating and the start and/or end of cooling, thus enabling contribution to improvement in heat-exchange efficiency.

Figure 16:
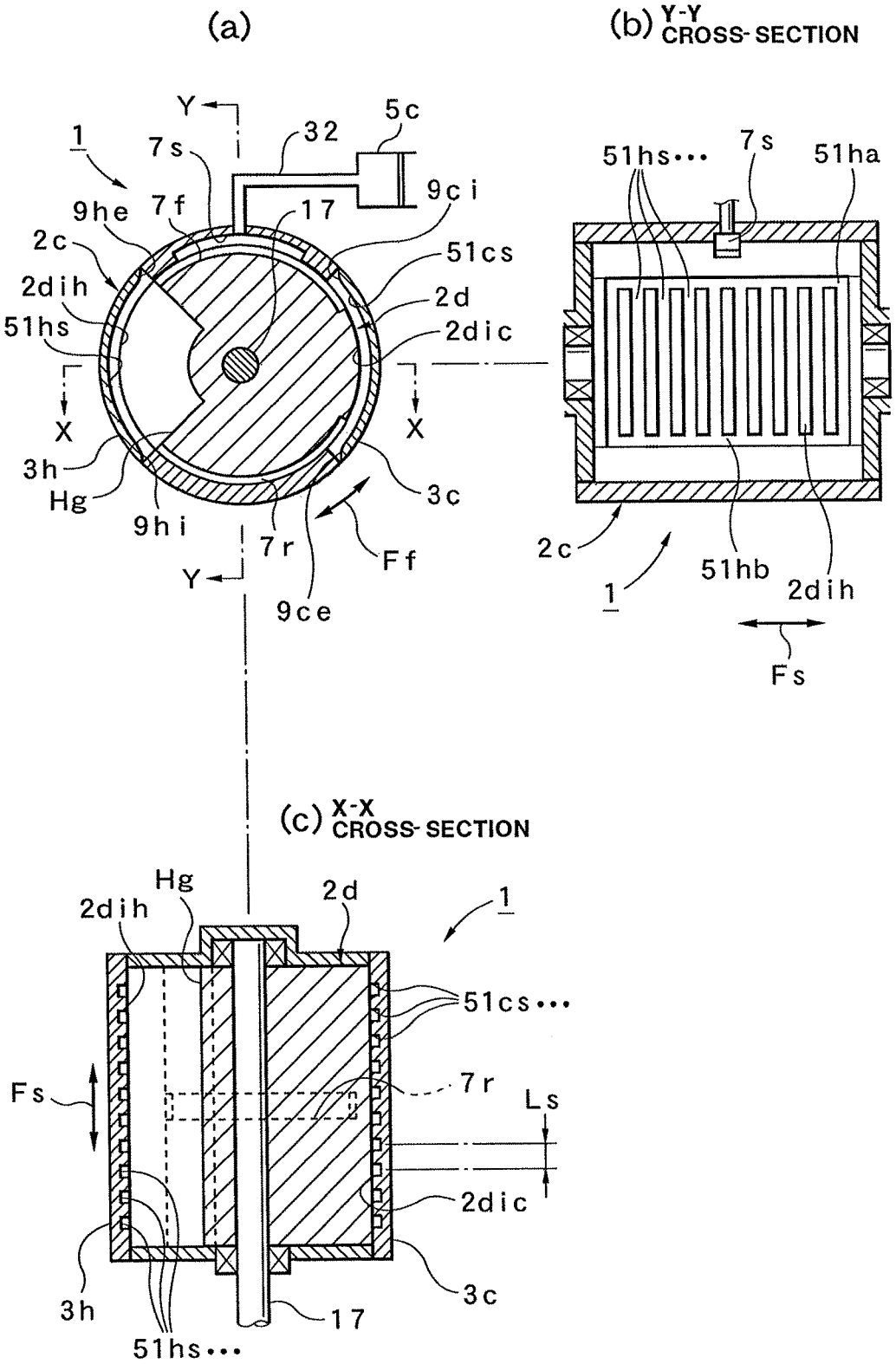
FIG. 16 is an internal structural diagram theoretically showing a Stirling engine according to a modification of the modified embodiment shown in FIG. 15.

FIG. 16 shows a modification of the modified embodiment shown in FIG. 15. The corrugated surfaces, by which the inner circumferential surfaces 2*dih* and 2*dic* are formed, are formed by a plurality of depressed grooves 51*hs* . . . and 51*cs* . . . placed at predetermined intervals Ls . . . in the axial direction Fs as shown in FIG. 16(*c*) and extending along the circumferential direction Ff as shown in FIGS. 16(*a*) and (*b*). In the case thus exemplified, as shown in FIG. 16(*c*), the depressed grooves 51*hs* . . . on the heating unit 3*h* side have rectangular cross-sectional shapes, and at both ends of each of the depressed grooves 51*hs* . . . , common depressed grooves 51*ha* and 51*hb*, formed in an orthogonal direction to communicate the ends of each of the depressed grooves 51*hs* . . . with each other, are provided.

With this, at a point in time where a leading end side of the gas retention space Hg in a rotational direction (circumferential direction Ff) reaches the common depressed groove 51*hb*, the working gas G in the gas retention space Hg enters each of the depressed grooves 51*hs* . . . on the inner circumferential surfaces 2*dih* of the heating unit 3*h*. This makes it possible to advance the heating starting timing, in addition to increasing the actual surface area with the corrugated surfaces, thus making it possible to further increase heat-exchange efficiency. It should be noted that the depressed grooves 51*cs* . . . on the cooling unit 3*c* side can also be configured (formed) in the same manner as the abovementioned heating unit 3*h* side. This makes it possible to advance the cooling starting timing, in addition to increasing the actual surface area with the corrugated surfaces on the cooling unit 3*c* side, too, thus making it possible to further increase heat-exchange efficiency.

Although FIG. 16 exemplifies a case where the depressed grooves 51*hs* . . . are identical in groove width to each other and are placed at regular intervals, the depressed grooves 51*hs* . . . may be different in groove width from each other and be placed at different intervals. The same applies to the other depressed grooves 51*cs* . . . . In addition, even in the case of the modification shown in FIG. 16, the auxiliary spaces 9*hi*, 9*he*, 9*ci*, and 9*ce* may be provided in the same manner. Of course, the auxiliary spaces 9*hi*, 9*he*, 9*ci*, and 9*ce* may or may not be provided.

Figure 17:
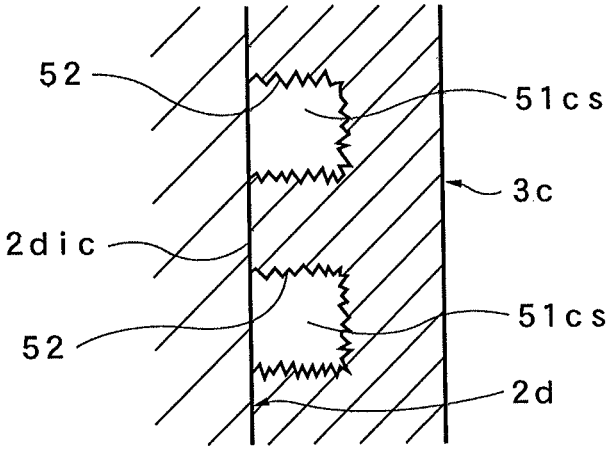
FIG. 17 is a cross-sectional shape diagram showing a partial enlargement of a structure according to a modification obtained by changing a part of the Stirling engine shown in FIG. 16.
Figure 18:
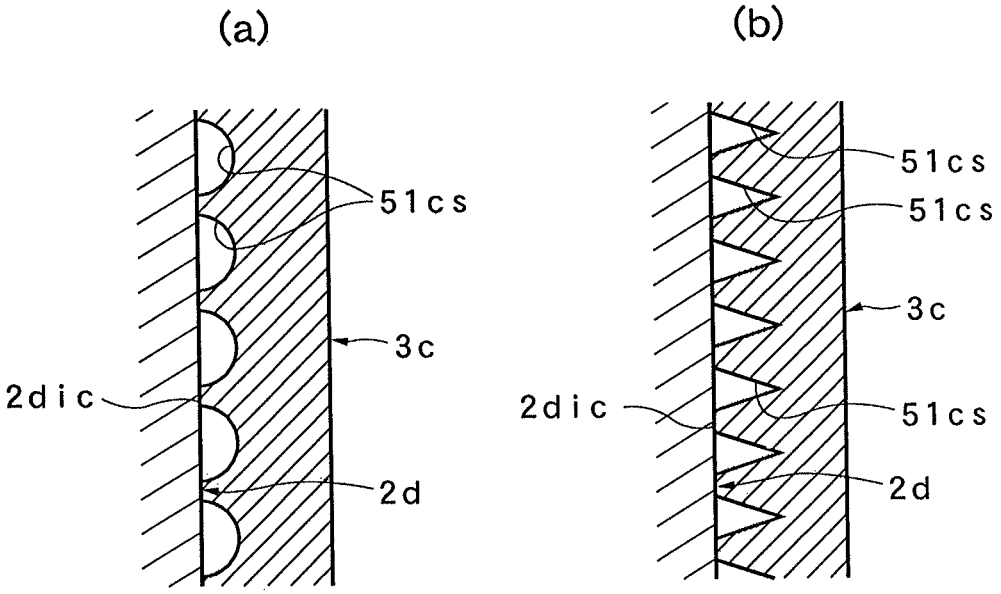
FIG. 18 is a cross-sectional shape diagram showing a partial enlargement of a structure according to another modification obtained by changing a part of the Stirling engine shown in FIG. 16.

Further, FIGS. 17 and 18 show modifications each obtained by further modifying a part of the modification shown in FIG. 16. In FIG. 17, some or all of the inner surfaces 52 of the depressed grooves 51*cs* . . . (same applies to the depressed grooves 51*hs* and the common depressed grooves 51*ha* and 51*hb*) shown in FIG. 16 are formed as two-dimensional corrugated surfaces. This makes it possible to further increase the actual heat-transfer area between the heating and/or cooling unit(s) 3*h* . . . and/or 3*c* . . . and the working gas G, thus making it possible to contribute to further improvement in heat-exchange efficiency. Meanwhile, FIG. 18 shows a modification of the cross-sectional shape of each of the depressed grooves 51*cs* . . . . FIG. 18(*a*) shows an example where the cross-sectional shape of each of the depressed grooves 51*cs* is a semicircular shape, and FIG. 18(*b*) shows an example where the cross-sectional shape of each of the depressed grooves 51*cs* is a triangular shape. Thus, the cross-sectional shapes of each of the depressed grooves 51*cs* can be any of various types of shapes formed in consideration of processability (manufacturability) and the like. Furthermore, although, in the case thus exemplified, the corrugated surfaces (such as the depressed grooves 51*hs* . . . ) are directly formed on the inner circumferential surfaces 2*dih* and 2*dic*, the corrugated surfaces can be similarly configured (shaped) by incorporating separately-formed components.

Figure 19:
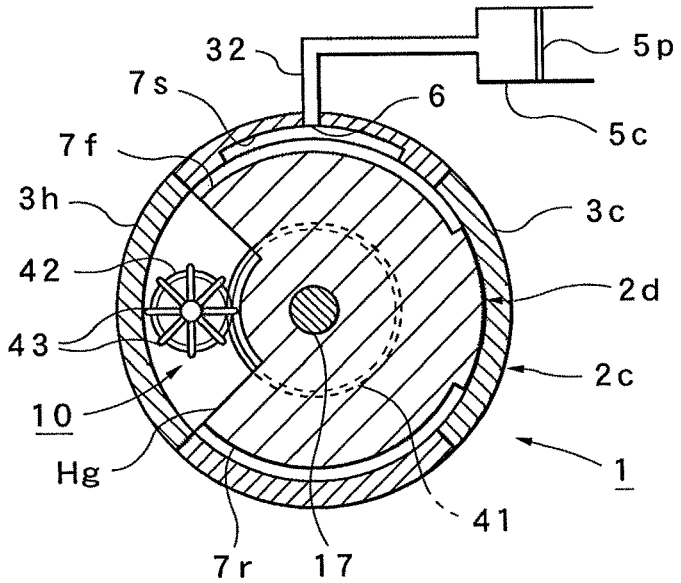
FIG. 19 is a cross-sectional front view theoretically showing an internal structure of a Stirling engine according to another modified embodiment of the present invention.
Figure 20:
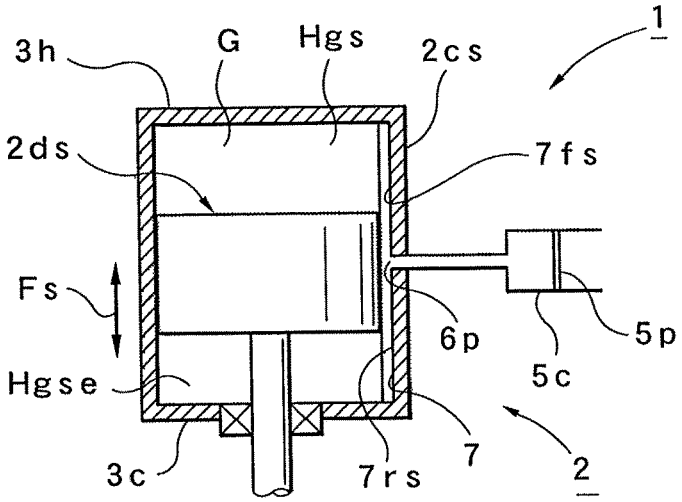
FIG. 20 is a cross-sectional side view theoretically showing an internal structure of a Stirling engine according to another modified embodiment of the present invention.

The modified embodiment shown in FIG. 19 differs from the basic embodiment shown in FIG. 1 in that the displacer 2*d* is additionally provided with a stirring mechanism 10 that stirs the content of the gas retention space Hg. The stirring mechanism 10 thus exemplified includes a transmitting gear 41 coaxially fixed with respect to the displacer 2*d*, a receiving gear 42 rotatably disposed inside of the gas retention space Hg, and a plurality of fins 43 . . . fixed to the receiving gear 42. With this, rotation of the displacer 2*d* causes the transmitting gear 41 to rotate, and this rotation of the transmitting gear 41 causes the receiving gear 42, and by extension the fins 43 . . . , to rotate. As a result, this rotation of the fins 43 . . . causes the working gas G in the gas retention space Hg to be stirred. This makes it possible to contribute to further improvement in heat conversion efficiency.

The modified embodiment shown in FIG. 20 is one in which, in configuring the displacer body unit 2, the displacer body unit 2 is provided with a linear displacer 2*ds* that has a circular cylindrical shape and is displaced forward and backward in the axial direction Fs and a displacer cylinder 2*cs* whose inner circumferential surface is provided with a gas passageway 7 extending along the axial direction Fs. With this, repetitive displacement of the displacer 2*ds* in the axial direction Fs by an actuator (not illustrated) allows the Stirling engine 1 to operate. That is, in the case thus exemplified, an upper end face of the displacer cylinder 2*cs* is heated as the heating unit 3*h*, and a lower end face of the displacer 2*cs* is cooled as the cooling unit 3*c*. Then, when the displacer 2*ds* is displaced toward the lower end, a gas retention space Hgs appears on the upper side and is heated by the heating unit 3*h*, so that the working gas G in the gas retention space Hgs expands. The portion of the gas G having thus expanded in volume acts on the power cylinder 5*c* via a front passageway 7*fs* and a working gas inlet/outlet 6*p* to cause the power piston 5*p* to move in such a direction as to project. On the other hand, when the displacer 2*ds* is displaced toward the upper end, a gas retention space Hgse appears on the lower side and is cooled by the cooling unit 3*c*, so that the working gas G in the gas retention space Hgse contracts. The portion of the gas G having thus contracted in volume acts on the power cylinder 5*c* via a rear passageway 7*rs* and the working gas inlet/outlet 6*p* to cause the power piston 5*p* to move in such a direction as to retract. Thus, even when the Stirling engine 1 uses the linear displacer 2*ds*, the Stirling engine 1 can bring about certain working effects based on the gas passageway 7 provided according to the present invention. It should be noted that, in FIGS. 1 to 20, components that are identical in basic configuration are given the same reference numeral, and the configuration is clarified.

In the foregoing, the best embodiment (and the modified embodiments) has/have been described in detail. However, the present invention is not limited to these embodiments. The configurations, shapes, materials, numbers, techniques, and the like of details can be freely modified, added, or deleted, provided such modifications, additions, and deletions do not depart from the gist of the present invention.

For example, although, in the basic embodiment shown in FIG. 1, the cylinder body 11 is configured by a combination of four panel members equally divided in a circumferential direction, the panel members can be divided or combined in any fashion or manner, and this is not intended to exclude a case where the cylinder body 11 is integrally formed. Further, although a case where the working gas inlet/outlet 6 is disposed in substantially the middle of the upper heat-insulting panel 13*u* in the axial direction Fs and the circumferential direction Ff has been exemplified, the working gas inlet/outlet 6 may alternatively be disposed in any selected position in the cylinder body 11. Therefore, the position in which the gas passageway 7 is provided can be any position that corresponds to the position of the working gas inlet/outlet 6. It should be noted that, instead of providing one gas passageway 7 (front passageway 7*f*, rear passageway 7*r*) in the axial direction Fs, it is possible to provide a plurality of gas passageways 7 at predetermined intervals or dispose the front passageway 7*f* and the rear passageway 7*r* to be offset relative to each other in the axial direction Fs. Furthermore, although examples where one or two working gas inlet/outlets 6 (6*e*, 6*p*) are provided have been shown, three or more working gas inlet/outlets may alternatively be provided. On the other hand, the inner circumferential surface which is formed by a corrugated surface to enlarge the actual surface area may be provided only on either 2*dih* or 2*dic*, and one or two among the auxiliary spaces 9*hi*, 9*he*, 9*ci*, and 9*ce* may be selectively provided. Meanwhile, the clearance adjustment mechanisms 8*x* . . . , the position adjustment mechanisms 8*y* . . . , and the stirring mechanism 10 may be replaced by other various types of components, provided such components can fulfill the same functions. In addition, although the rotary generator 33, which rotates the rotation input shaft 33*s* via the crank mechanism 34, has been exemplified, it may be replaced by a linear generator that enables direct input of a motion of the power piston 5*p*. Further, although a case has been shown where the electric motor 21 is used as the driving actuator 4, this is not intended to exclude a configuration in which the rotation output of the crank mechanism connected to the power piston 5*p* is directly transmitted via a mechanical transmission mechanism to the displacer 2*d*.

INDUSTRIAL APPLICABILITY

A Stirling engine according to the present invention can be used for various purposes as various types of power sources, such as the exemplified purpose of generating electricity. In particular, the Stirling engine is not bound by its name, and is a concept that encompasses various types of heat engine whose principles are the same or similar and to which the present invention can be applied.

The invention claimed is:

1. A Stirling engine comprising:

a displacer body unit having a displacer cylinder in which a working gas and a rotatable displacer are accommodated;

a cooling and heating working unit having a heating unit that heats a first side of the displacer cylinder and a cooling unit that cools a second side of the displacer cylinder;

a displacer-driving actuator that rotates the rotatable displacer; and a power output unit having a power cylinder containing a power piston that is moved by an effect of volume change of the working gas in the displacer cylinder, wherein the rotatable displacer has a gas retention space formed therein, the gas retention space enabling the working gas to be alternately moved between a heating unit side and a cooling unit side of the displacer cylinder by rotary movement of the displacer, wherein the rotatable displacer has an outer circumferential surface and the displacer cylinder has an inner circumferential surface, formed to permit the rotary movement of the displacer and inhibit passage of the working gas, and wherein the rotatable displacer has a gas passageway formed on the outer circumferential surface of the rotatable displacer, including a gas passage groove for communicating the gas retention space with a radially extending working gas inlet/outlet provided in the displacer cylinder and connected to the power cylinder.

2. The Stirling engine according to claim 1, wherein the displacer body unit includes a precisely circular cylindrical rotary displacer whose outer circumferential surface is parallel to an axial direction with respect to a central axis on which the displacer rotates and whose gas retention space is formed by notching a part of the outer circumferential surface, and wherein the heating unit and the cooling unit are disposed in 180-degree opposed positions, respectively, on an outer surface of the displacer cylinder in a radial direction.

3. The Stirling engine according to claim 1, wherein the gas passageway is constituted by a front passageway extending from a first end of the gas retention space in a circumferential direction along the circumferential direction of the displacer and a rear passageway extending from a second end of the gas retention space in the circumferential direction along the circumferential direction of the displacer, and wherein the front passageway and the rear passageway are formed as discontinuous passageways that are independent of each other.

4. The Stirling engine according to claim 1, wherein the gas passageway is constituted by a front passageway extending from a first end of the gas retention space in a circumferential direction along the circumferential direction of the displacer and a rear passageway extending from a second end of the gas retention space in the circumferential direction along he circumferential direction of the displacer, and wherein the front passageway and the rear passageway are formed as continuous passageways that communicate with each other.

5. The Stirling engine according to claim 1, wherein the displacer cylinder has one or two or more of these working gas inlet/outlets.

6. The Stirling engine according to claim 1, wherein the displacer cylinder has an auxiliary gas passageway formed on a part of the inner circumferential surface that faces the working gas inlet/outlet and including a gas passage groove communicating with the gas passageway across a predetermined range of angles in the circumferential direction.

7. The Stirling engine according to claim 1, wherein the displacer body unit includes clearance adjustment mechanisms that are capable of adjusting clearances between both end faces of the displacer and inner surfaces of ends of the displacer cylinder.

8. The Stirling engine according to claim 1, wherein the displacer body unit includes a rotary displacer whose outer circumferential surface is tapered with respect to a central axis on which the displacer rotates and whose gas retention space is formed by notching a part of the outer circumferential surface, wherein the heating unit and the cooling unit are disposed in 180-degree opposed positions, respectively, on an outer surface of the displacer cylinder in a radial direction, and wherein the displacer body unit includes position adjustment mechanisms that are capable of adjusting the position of the displacer in an axial direction with respect to the displacer cylinder.

9. The Stirling engine according to claim 1, wherein the inner circumferential surface of the displacer cylinder includes an inner circumferential surface(s) corresponding to the heating unit and/or the cooling unit and is formed as a corrugated surface(s) to enlarge the actual surface area.

10. The Stirling engine according to claim 9, wherein the corrugated surface(s) is/are formed by a plurality of depressed grooves placed at predetermined intervals in an axial direction and extending along a circumferential direction.

11. The Stirling engine according to claim 10, wherein some or all of the depressed grooves have their inner surfaces formed as two-dimensional corrugated surfaces.

12. The Stirling engine according to claim 1, wherein the inner circumferential surface of the displacer cylinder includes an inner circumferential surface(s) corresponding to the heating unit and/or the cooling unit and provided with an auxiliary space(s) formed by notching a first end side and/or a second end side of the displacer cylinder in a circumferential direction.

13. The Stirling engine according to claim 1, wherein the displacer includes a stirring mechanism that stirs the content of the gas retention space.

14. The Stirling engine according to claim 1, wherein the displacer body unit includes a linear displacer that has a circular cylindrical shape and is displaced forward and backward in an axial direction, wherein the gas passageway is provided in the inner circumferential surface of the displacer cylinder and/or the outer circumferential surface of the displacer and extends in the axial direction, wherein the gas retention space is provided between inner surfaces of an end face of the displacer and an end face of the displacer cylinder, and wherein the heating unit and the cooling unit are disposed on outer surfaces of end faces of the displacer cylinder in the axial direction, respectively.

15. The Stirling engine according to claim 2, wherein the gas passageway is constituted by a front passageway extending from a first end of the gas retention space in a circumferential direction along the circumferential direction of the displacer and a rear passageway extending from a second end of the gas retention space in the circumferential direction along the circumferential direction of the displacer, and wherein the front passageway and the rear passageway are formed as discontinuous passageways that are independent of each other.

16. The Stirling engine according to claim 2, wherein the gas passageway is constituted by a front passageway extending from a first end of the gas retention space in a circumferential direction along the circumferential direction of the displacer and a rear passageway extending from a second end of the gas retention space in the circumferential direction along he circumferential direction of the displacer, and wherein the front passageway and the rear passageway are formed as continuous passageways that communicate with each other.

17. The Stirling engine according to claim 5, wherein the displacer cylinder has an auxiliary gas passageway formed on a part of the inner circumferential surface that faces the working gas inlet/outlet and including a gas passage groove communicating with the gas passageway across a predetermined range of angles in the circumferential direction.

18. The Stirling engine according to claim 2, wherein the displacer body unit includes clearance adjustment mechanisms that are capable of adjusting clearances between both end faces of the displacer and inner surfaces of ends of the displacer cylinder.

* * * * *